US006604397B2

(12) United States Patent
Patty et al.

(10) Patent No.: US 6,604,397 B2
(45) Date of Patent: Aug. 12, 2003

(54) ROLLFORMING MACHINE

(75) Inventors: Alfred C. Patty, Portage, IN (US); John M. Pacalo, III, Pittsburgh, PA (US); Norman J. Hedman, Hilliard, OH (US); Larry E. Stimpert, II, Ashland, OH (US); Joseph A. Jinkens, New Albany, OH (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/777,015

(22) Filed: Feb. 5, 2001

(65) Prior Publication Data

US 2002/0104355 A1 Aug. 8, 2002

(51) Int. Cl.[7] ..... B21D 5/08
(52) U.S. Cl. ..... 72/178
(58) Field of Search ..... 72/178, 182, 176

(56) References Cited

U.S. PATENT DOCUMENTS

| | | | | | |
|---|---|---|---|---|---|
| 606,306 | A | * | 6/1898 | Shann | 72/178 |
| 1,366,331 | A | * | 1/1921 | Palmer | 72/178 |
| 1,669,411 | A | | 5/1928 | Clark | |
| 1,673,787 | A | | 6/1928 | Frahm et al. | |
| 1,763,797 | A | * | 6/1930 | Magee | 72/178 |
| 1,831,311 | A | * | 11/1931 | Magee | 72/182 |
| 2,102,355 | A | | 12/1937 | Cummins | |
| 2,159,771 | A | * | 5/1939 | Schlight | 72/178 |
| 2,195,398 | A | | 4/1940 | Duda | |
| 2,294,324 | A | | 8/1942 | Wilkens et al. | |
| 2,405,128 | A | | 8/1946 | Berquist | |
| 2,561,634 | A | | 7/1951 | Picton | |
| 2,601,794 | A | | 7/1952 | Wood | |
| 2,664,019 | A | | 12/1953 | Henderson | |
| 2,774,263 | A | | 12/1956 | Leufven | |
| 2,843,178 | A | | 7/1958 | Nighthart | |
| 2,974,710 | A | | 3/1961 | Braeuninger | |
| 3,138,979 | A | | 6/1964 | Sendzimir | |
| 3,309,909 | A | | 3/1967 | Wilson | |
| 3,345,849 | A | | 10/1967 | Lowy | |
| 3,348,403 | A | | 10/1967 | Bartley | |
| 3,355,922 | A | * | 12/1967 | Utashiro et al. | 72/178 |
| 3,452,568 | A | | 7/1969 | Vihl | |
| 3,468,150 | A | | 9/1969 | Ruple | |
| 3,577,760 | A | | 5/1971 | Franke | |
| 3,595,054 | A | | 7/1971 | Sendzimir | |
| 3,691,810 | A | | 9/1972 | Tadeusz | |
| 3,748,884 | A | | 7/1973 | Colbath | |
| 3,823,592 | A | | 7/1974 | Colbath | |
| 3,903,723 | A | | 9/1975 | Colbath | |
| 3,914,971 | A | | 10/1975 | Colbath | |
| 4,007,617 | A | | 2/1977 | Falk et al. | |
| 4,019,358 | A | | 4/1977 | Frohling et al. | |
| 4,033,165 | A | | 7/1977 | Arimura et al. | |
| 4,045,989 | A | | 9/1977 | Ryan | |
| 4,156,453 | A | | 5/1979 | Scheinecker | |
| 4,201,352 | A | | 5/1980 | Madachy | |

(List continued on next page.)

FOREIGN PATENT DOCUMENTS

| | | |
|---|---|---|
| CA | 1092864 | 1/1981 |
| DE | 1777039 | 10/1971 |
| EP | 0 247 886 A2 | 12/1987 |
| EP | 1 022 072 A2 | 7/2000 |
| FR | 2 436 634 | 9/1978 |
| JP | 45-26320 | 9/1972 |
| WO | WO 97/04892 | 7/1996 |

*Primary Examiner*—Daniel C. Crane
(74) *Attorney, Agent, or Firm*—Kirkpatrick & Lockhart LLP

(57) ABSTRACT

A rollforming machine includes an apparatus for adjusting a forming roll for forming components from materials of different thicknesses. The rollforming machine further includes an apparatus structured and arranged for overbending the component being rollformed.

24 Claims, 34 Drawing Sheets

U.S. PATENT DOCUMENTS 4,237,714 A 12/1980 Polukhin et al.
4,286,451 A 9/1981 Chang
4,316,377 A 2/1982 Fencl et al.
4,320,327 A 3/1982 Fencl
4,357,561 A 11/1982 Fencl
4,368,633 A 1/1983 Nogota
4,412,443 A 11/1983 Stoehr
4,453,393 A 6/1984 Hino et al.
4,468,944 A 9/1984 Foss
4,502,311 A 3/1985 Eibe
4,557,129 A 12/1985 Lash et al.
4,559,482 A 12/1985 Fencl
4,655,067 A 4/1987 Frost et al.
4,715,206 A 12/1987 Forni
4,716,754 A 1/1988 Youngs
4,724,695 A 2/1988 Stoehr
4,776,194 A 10/1988 Chang
4,787,232 A 11/1988 Hayes
4,831,857 A 5/1989 Levy et al.
4,942,753 A 7/1990 Willeke
4,959,099 A 9/1990 Wilson
4,969,347 A 11/1990 Matsuo et al.
4,974,435 A 12/1990 Vandenbroucke
5,090,227 A 2/1992 Takeda et al.
5,142,894 A 9/1992 Gutowski
5,158,002 A 10/1992 Matsunaga et al.
5,163,311 A 11/1992 McClain et al.
5,187,964 A 2/1993 Levy
5,199,291 A 4/1993 Bahl, Jr. et al.
5,319,952 A * 6/1994 Cadney ..... 72/178
5,351,516 A 10/1994 Bialy
5,644,942 A 7/1997 Bradbury
5,669,260 A 9/1997 Stampfl et al.
5,722,278 A 3/1998 Horino et al.
5,732,582 A 3/1998 Knudson
5,755,131 A 5/1998 Voth
5,791,241 A 8/1998 Levy
5,799,573 A 9/1998 Levy
5,816,144 A 10/1998 Schandl et al.
5,829,294 A 11/1998 Bradbury et al.
5,829,295 A 11/1998 Voth et al.
5,855,133 A 1/1999 Hayes
5,943,892 A 8/1999 Hoshi et al.
5,970,764 A 10/1999 Surina
5,983,691 A 11/1999 Voth et al.
6,000,266 A 12/1999 Strecker et al.
6,085,567 A 7/2000 Cattaneo et al.
6,109,083 A 8/2000 Steinmair

* cited by examiner

ROLLFORMING MACHINE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The invention relates to rollforming machines and, more particularly, to adjustable rollforming machines for forming components from materials of different thicknesses and rollforming machines having the capability to overbend the component being formed.

2. Description of the Invention Background

Rollforming is a well-know process of bending a continuous strip or cut to length strip of metal through a series of shaped rolls. Common rollforming processes gradually form a strip of metal into a predetermined shape. The shapes may include, for example, generally C-shaped cross sections or generally U-shaped cross sections, or may include relatively complex formations being formed along the length of the material.

Rollforming processes are widely used because they are regarded as being a highly efficient means for continuously forming metal strip. Any number of other operations may be performed while the metal is taking shape. These other operations may include, for example, punching, tabbing, cutting to length, perforating, drawing, lancing, embossing, knurling, edge conditioning and curving. One particular benefit of rollforming is that strength and function are added to the metal as a result of the rollforming process. Rollforming, therefore, provides for many advantages in comparison to other known processes for forming metal materials.

The marketplace for shaped, rollformed sections has expanded into virtually every field of industry thereby replacing other known processes such as extrusions, brake forming and punch press operations in the areas such as the aircraft industry and the automotive industry. Another industry that heavily relies on rollforming is the architectural industry, and more specifically, the metal frame construction industry. As an alternative to traditional wood construction components, a variety of metal frame constructions and associated components have been developed for use in the residential and/or commercial building industry. The components needed for the metal frame construction industry are greatly varied and thus can be time consuming and expensive to manufacture using conventional rollforming techniques. For example, the needed components must be manufactured in an assortment of sizes, gauges and shapes depending upon the particular need for an assortment of different residential and/or commercial structures in which the components will be utilized. In addition, such components must be manufactured to relatively close tolerances to ensure that they will fit together properly and can easily be assembled and installed.

Rollforming machines for producing components used, for example, in the metal frame construction industry, are well known and typically include a plurality of sets of forming rolls arranged in upper and lower pairs and spaced apart along the length of the rollforming machine on rollforming support stands. As is also well known, the forming rolls at one stand will produce a continuous formation in the material and the forming rolls of the next stand will produce another formation, or for example, increase the angle of the formation which has already been started at the previous stand and so on. Examples of such rollforming machines are disclosed, in U.S. Pat. Nos. 5,970,764 and 5,829,295.

When rollforming a strip of metal to produce a component, it is advantageous for the rollforming machine to be capable of working on materials of different thicknesses, also referred to as the "gauge" of the material in the metals industry. In order to achieve this flexibility of working on materials of different thicknesses, early rollforming machines required that the forming rolls be replaced entirely or substantially changed when it was desirable to form a material having a different thickness. As can be appreciated, this practice of completely replacing the forming rolls was very costly in terms of material costs to provide numerous different forming rolls, labor costs for the added time of installing and reinstalling the forming rolls, and the manufacturing costs in view of the time that the rollforming machine could not be in operation during replacement of the forming rolls. More modern rollforming machines provide for automatic adjustment of the forming rolls to accommodate the materials of different thicknesses. For example, the aforementioned U.S. Pat. No. 5,970,764 discloses a first rack and pinion arrangement in combination with an eccentrically mounted shaft for adjusting the clearance between forming rolls in a first plane and a second rack and pinion arrangement in combination with an additional eccentrically mounted shaft for adjusting the clearance between the forming rolls in a second plane. While apparently effective at adjusting the clearance between the forming rolls for materials of different thicknesses, such an arrangement still has many disadvantages and shortcomings. For example, many mechanical parts are necessary to achieve the desired adjustment resulting in increased costs for manufacturing and maintaining the rollforming machine, and also resulting in the increased likelihood of mechanical failure leading to down time and lost operating revenue for the rollforming machine. In addition, such arrangement is apparently unable to accurately and consistently maintain the required tolerances when rollforming a component.

When performing a rollforming process to produce a component of a particular shape, it is desirable for the component to maintain the desired shape after the rollforming process is completed and the component exits the rollforming machine. One problem that can occur when rollforming products is commonly referred to in the rollforming industry as "springback". The bending process that takes place during rollforming is a complex process which seeks to avoid stress concentration at the points of bending. Because the material being rollformed has a modulus of elasticity, the material tries to assume a shape having a bend of lesser extent than was desired. Therefore, springback is generally defined as the elastic recovery of metal after a stress has been applied. Other properties of the metal which may affect and contribute to springback are, for example, tensile strength, yield strength and Rockwell hardness. As can be appreciated, the amount of springback that may occur will vary for different materials and for different shapes depending upon the degree of bending.

One solution to correcting springback is to rework the rollformed component to mitigate the effects of the springback. However, to rework the component greatly increases the unit cost for the component and, therefore, is not an effective solution. Another solution to springback is to employ additional rollforming stands on the rollforming machine that include forming rolls cut to specific angles in order to overbend the component once the desired shape has been achieved. However, this also greatly increases the costs of rollforming by requiring additional rollforming stands and increased material and labor costs to install and replace the forming rolls depending upon the particular angle that is needed in order to achieve the necessary overbend to compensate for the springback.

There is identified, therefore, a need for an improved rollforming machine that overcomes limitations, shortcomings and disadvantages of known rollforming machines.

There is also a need for an improved rollforming machine that is capable of accommodating materials of different thicknesses.

There is a further need for an improved rollforming machine that can be easily and efficiently adjusted for materials of different thicknesses and profiles.

There is a further need for an improved rollforming machine that is capable of producing a component of a desired shape or configuration wherein the component maintains the desired shape or configuration once the rollforming is completed and the component is removed from the rollforming machine.

Still another need exists for an improved rollforming machine with effective overbending capabilities for ensuring that the component formed by the rollforming machine maintains the desired shape or configuration once the rollforming is completed and the component is removed from the rollforming machine.

A need also exists for an improved rollforming machine that includes overbend capabilities wherein the desired and necessary amount of overbending can easily be adjusted and maintained while running production and during non-production.

SUMMARY OF THE INVENTION

The embodiments of the invention meet the above-identified needs, as well as other needs, as will be more fully understood following a review of this specification and drawings.

An embodiment of the invention includes a rollforming apparatus comprising a moveable support stand, a first forming roll, a second forming roll and a third forming roll. The first forming roll is rotatably mounted to a first spindle, wherein the first spindle is moveably connected to the support stand to provide for angular movement of the first forming roll. The second forming roll is mounted to a second spindle that extends through a central aperture defined by the first forming roll. The second spindle is moveably connected to the support stand to provide for movement of the second forming roll relative to the angular movement of the first forming roll. The third forming roll is rotatably supported by the support stand for movement therewith.

The rollforming apparatus may be utilized in conjunction with a rollforming machine that is structured and arranged to form components of different shapes and configurations, such as, for example, components having a generally C-shaped cross section, components having a generally U-shaped cross section or components with other cross sections as may be needed for particular applications. Advantageously, the first, second and third forming rolls of the rollforming apparatus are structured and arranged to perform, for example, overbending of the component to counter the effects of springback that may occur during the rollforming process.

A further embodiment of the invention includes a method of forming components of different shapes and configurations, such as, for example, a component having a generally C-shaped cross section, a component having a generally U-shaped cross section or a component having other cross sections depending upon the particular shape needed for a particular application of the component. The method includes feeding a sheet or coil of material to a rollforming station structured and arranged to form a portion of the component. The method also includes feeding the sheet of material to an additional rollforming station having a plurality of forming rolls supported by a plurality of spindles. The method further includes adjusting the position of at least one of the forming rolls resulting in moving the position of at least one of the spindles. Advantageously, the method may further include employing the roll station having a plurality of forming rolls supported by a plurality of spindles for overbending of a sheet of material to compensate for springback conditions that may develop in the component being formed.

An additional embodiment of the invention includes a rollforming apparatus comprising a support stand, a forming roll supported on a spindle, an adjustment block and a slide assembly. The spindle is rotatably secured to the adjustment block. The slide assembly is in cooperative engagement with the support stand and the adjustment block to provide movement of the forming roll axially along an axis of rotation of the spindle and transversely to the axis of rotation of the spindle.

The slide assembly may include an inner gage block mounted to the adjustment block and an outer gage block mounted to the support stand. The slide assembly may further include a rail member and a bearing member such that one of the rail member and the bearing member is attached to the inner gage block and the other of the rail member and the bearing member is attached to the outer gage block. The rail member and the bearing member are positioned for cooperative engagement to facilitate movement between the support stand and adjustment block to provide for movement of the forming roll. Advantageously, the rollforming apparatus provides for easy and efficient adjustment of the forming roll for materials of different thicknesses.

In another embodiment of the invention, the rollforming apparatus having a support stand, a forming roll supported on a spindle, an adjustment block and a slide assembly may be utilized in conjunction with a rollforming machine having a plurality of rollforming stations to form a component of a desired shape and configuration.

An additional embodiment of the invention includes a method of forming a component that includes feeding a sheet or coil of material to a rollforming station having a forming roll supported by a spindle rotatably secured to an adjustment block to form the component. The method also includes adjusting the position of the forming roll by employing a slide assembly in cooperative engagement with the adjustment block to facilitate movement of the forming roll in a direction that is the resultant of normal and axial components of motion of the spindle.

DETAILED DESCRIPTION OF THE INVENTION

Referring to FIGS. 1A–1D and 2, there is illustrated a rollforming machine 10 in accordance with the invention. In general, rollforming machines are well known machines and they include numerous parts and components for the assembly and operation thereof. Many of these numerous parts and components that make up rollforming machines that are well known to those skilled in the art of manufacturing and operating rollforming machines will not be described in detail herein. Rather, the rollforming machine 10 will be described in general details with specific emphasis on the inventive aspects and the various embodiments of the invention.

Figure 3A:
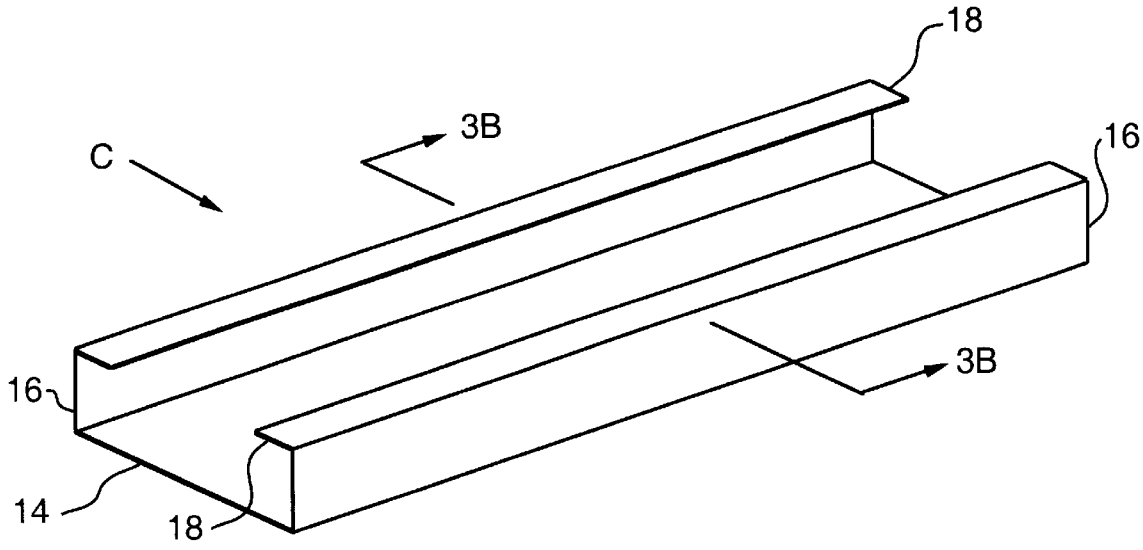
FIG. 3A is an isometric view of a component C capable of manufactured by the rollforming machine shown in FIG. 1A.
Figure 3B:
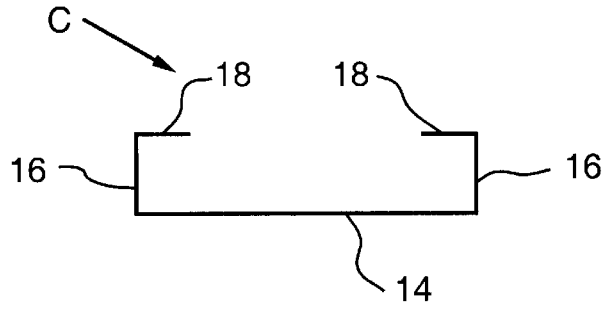
FIG. 3B is a front-elevational view taken along line 3B—3B of FIG. 3A.

The rollforming machine 10 includes a plurality of rollforming stations 12*a*–12*m*. The plurality of rollforming stations 12*a*–12*m* are positioned along the length of the rollforming machine 10 for gradually forming a strip or coil of metal into a predetermined shape or profile such as the component C, shown in FIGS. 3*a* and 3*b*, having a generally C-shaped cross section. Other components may be formed having different shapes or profiles such as, for example, a generally U-shaped cross section or other more relatively complex cross sections or formations that may be desired. The component C may be, for example, a metal stud member used, for example, in the metal frame construction industry. The component C generally includes a web 14, a pair of legs 16 connected to the web 14, and a pair of lips 18 connected to the legs 16. For purposes of illustration only, the rollforming machine 10 will be described in conjunction with the rollforming of the component C.

The rollforming machines 10 may also include a plurality of corresponding transmissions 20*a*–20*m* connected to the plurality of rollforming stations 12*a*–12*m* by a plurality of corresponding upper drive shafts 22*a*–22*i* for stations 12*a*–12*i* and lower drive shafts 23*a*–23*m* for stations 12*a*–12*m*. The plurality of transmissions 20*a*–20*m* may be integrally connected and driven by a common drive motor 17 that transmits a driving force to the transmissions 20*a*–20*m* via drive chain 19 or drive belt. The drive motor 17 may be of an appropriate size and capacity for providing the appropriate driving force to the plurality of rollforming stations 12*a*–12*m*. The drive shafts 22*a*–22*i* and 23*a*–23*m* will be discussed in more detail herein.

The rollforming machine 10 also includes moveable support frames 24 and 25 to which the plurality of rollforming stations 12*a*–12*m* are mounted. The support frames 24 and 25 are connected to a respective plurality of linear slides 26 and 27 to provide for lateral adjustment of the plurality of rollforming stations 12*a*–12*m* in order for the rollforming machine 10 to accommodate a particular component C having a web 14 of different widths. The linear slides 26 and 27 are mounted to a base assembly 28 which serves as the foundation for the rollforming machine 10.

Figure 1A:
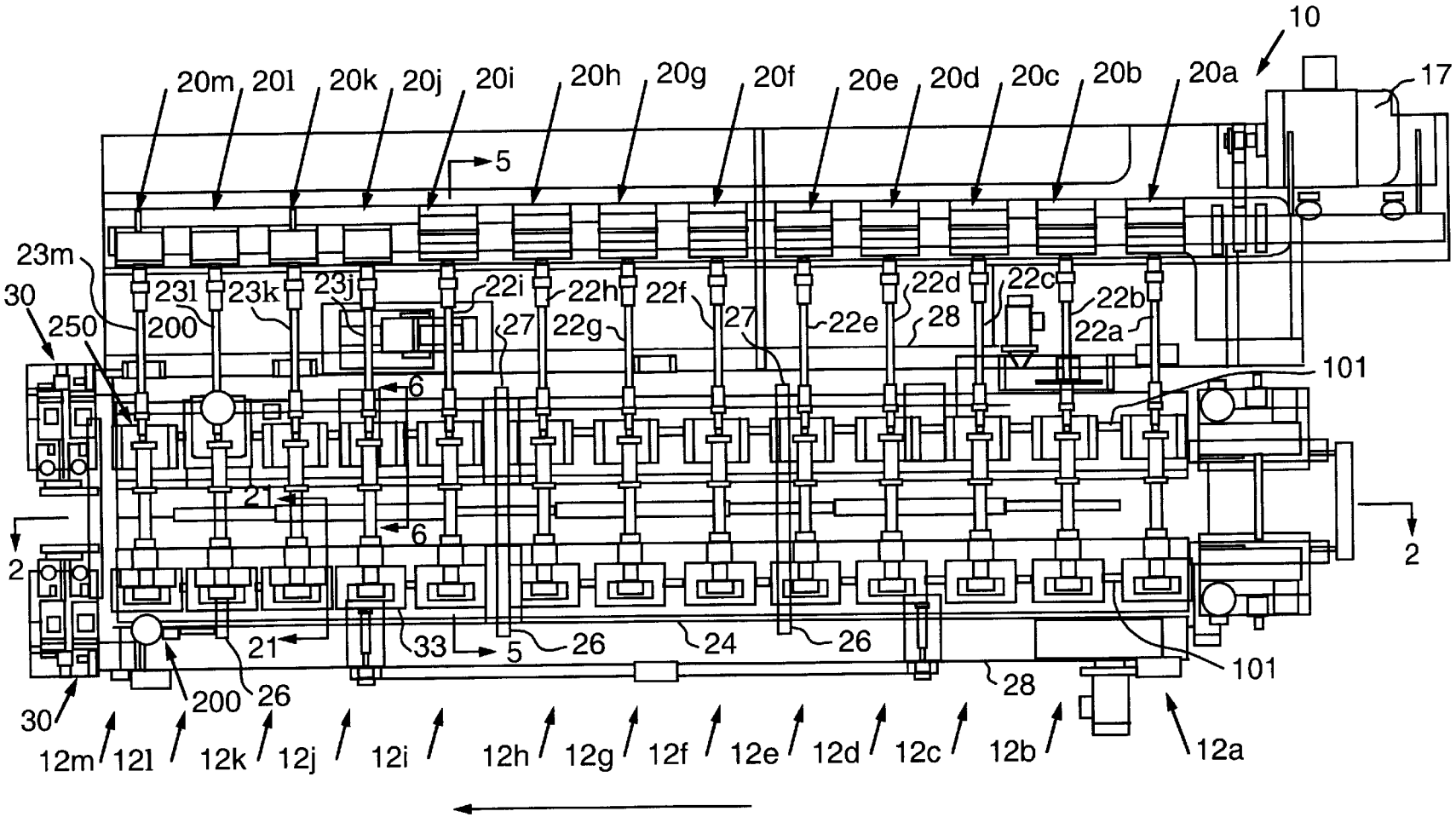
FIG. 1A is a top-plan view of a rollforming machine in accordance with an embodiment of the invention.
Figure 1B:
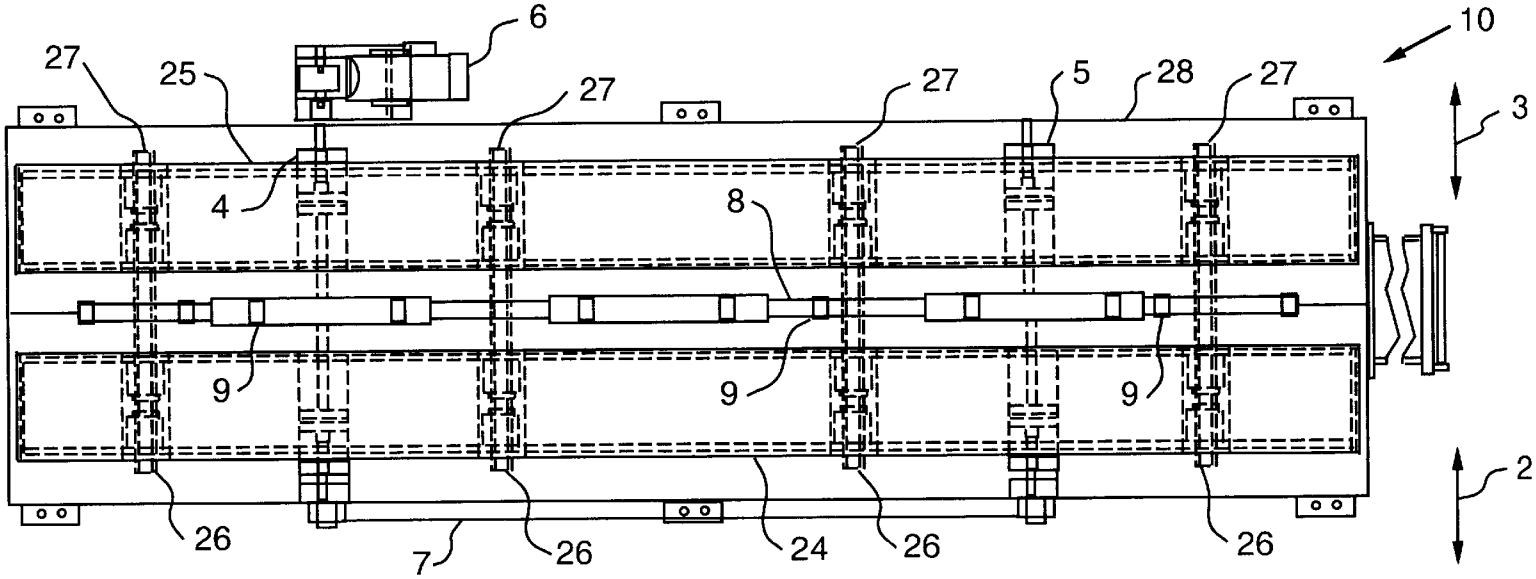
FIG. 1B is a top-plan view illustrating a portion of the rollforming machine shown in FIG. 1A.
Figure 1C:
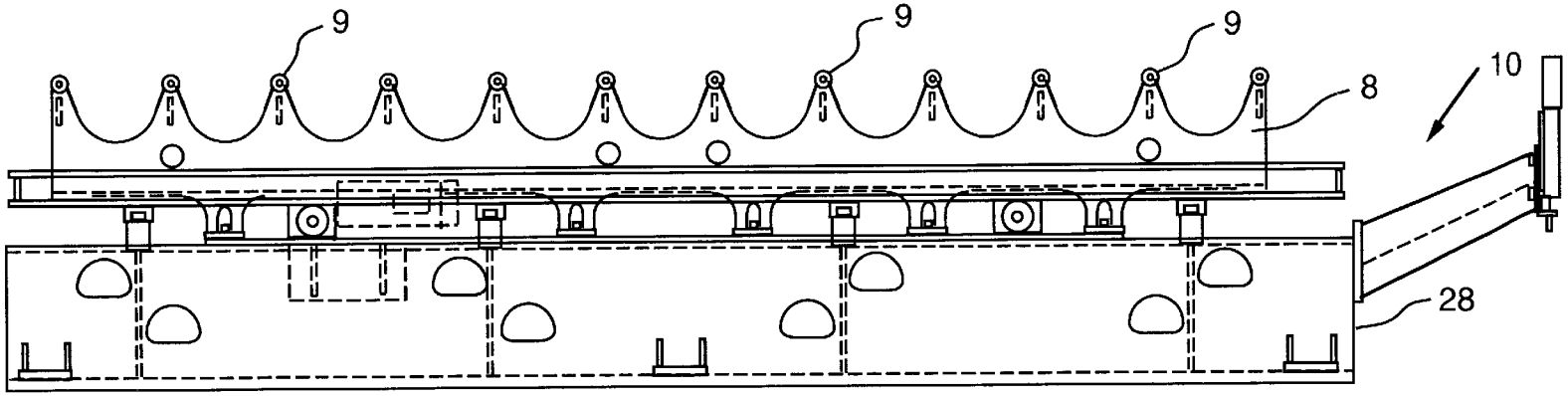
FIG. 1C is a side-elevational view of the rollforming machine as illustrated in FIG. 1B.

Referring to FIGS. 1A–1C, the support frame 24 is laterally adjustable in the directions indicated by arrow 2, while the support frame 25 is laterally adjustable in the directions indicated by arrow 3. In order to facilitate the lateral adjustment of the support frames 24 and 25, the rollforming machine 10 may include lateral adjustment assemblies 4 and 5 that are connected to the base assembly 28. The lateral adjustment assembly 4 may be connected to a drive motor 6 for actuation thereof. The lateral adjustment assembly 4 may be connected by, for example, a drive belt 7 to the lateral adjustment assembly 5. Many types of lateral adjustment assemblies may be employed, as is well known, for moving the support frames 24 and 25 laterally. The lateral adjustment assemblies 4 and 5 include, for example, pneumatic cylinders, hydraulic cylinders, powered and/or unpowered screw closure devices, including ball screws, acme screws or oppositely threaded screws for providing the desired lateral adjustment of the support frames 24 and 25. In addition to accommodating materials of different widths, the lateral adjustment of the support frames 24 and 25 also provide for formation of components C having legs 16 of unequal length.

The rollforming machine 10 may also include a support bridge 8 having a plurality of rollers 9 for contacting the web 14 of the component C being formed in order to prevent deflection of the web 14. The support bridge 8 may be mounted to the base assembly 28 or may be mounted to one of the support frames 24 and 25.

Figure 1D:
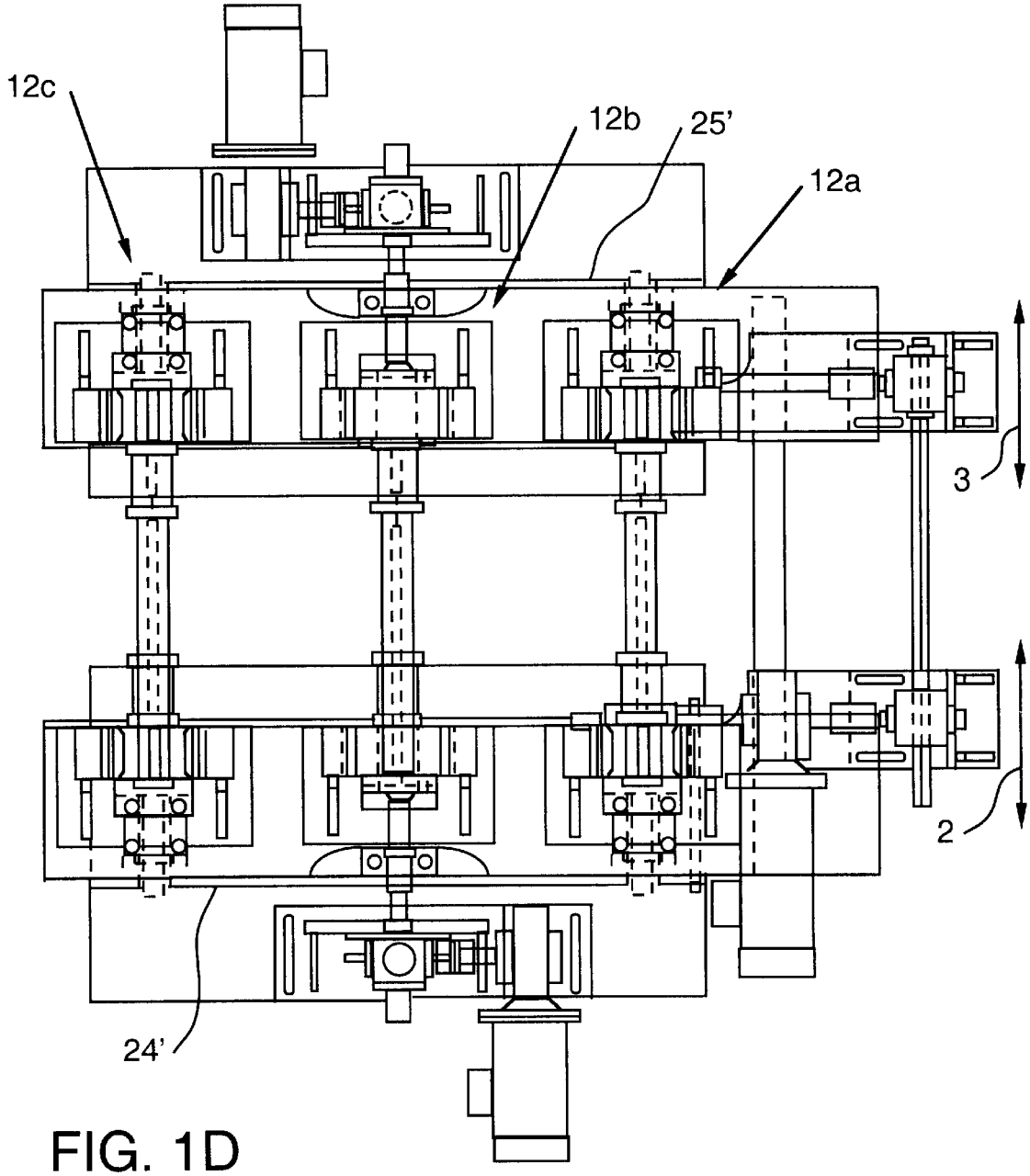
FIG. 1D is a top-plan view of an embodiment of rollforming stations 12*a*–12*c* of the rollforming machine shown in FIG. 1A.

Referring to FIG. 1D, the rollforming machine may include a split platform design to allow for enhanced lateral adjustment capabilities. This may be achieved by, for example, mounting rollforming stations 12*a*–12*c* on support frames 24' and 25' to increase the overall lateral adjustment capabilities. This is particularly advantageous for sheets of material entering the rollforming station 10 when the lips are being initially formed to accommodate the overall width of the sheet of material or when producing a component C having legs 16 of unequal lengths.

As can be seen in FIG. 1A, the rollforming machine 10 may also include a pair of straighteners 30, which will be described and shown in more detail herein. Generally, straighteners are well known components that are used in association with rollforming machines in order to correct, for example, bow, twist or camber that may result in the component C as it is being rollformed.

Referring to FIGS. 4A–4I, the operation of the plurality of rollforming stations 12*a*–12*i* will be described in more detail. Each of the rollforming stations 12*a*–12*i* include a pair of upper forming rolls mounted on a spindle and a pair of lower forming rolls mounted on a spindle. A strip of material is fed to the rollforming stations 12*a*–12*i* which progressively form the component C, and more specifically, form the legs 16 and lips 18 thereof.

Figure 4A:
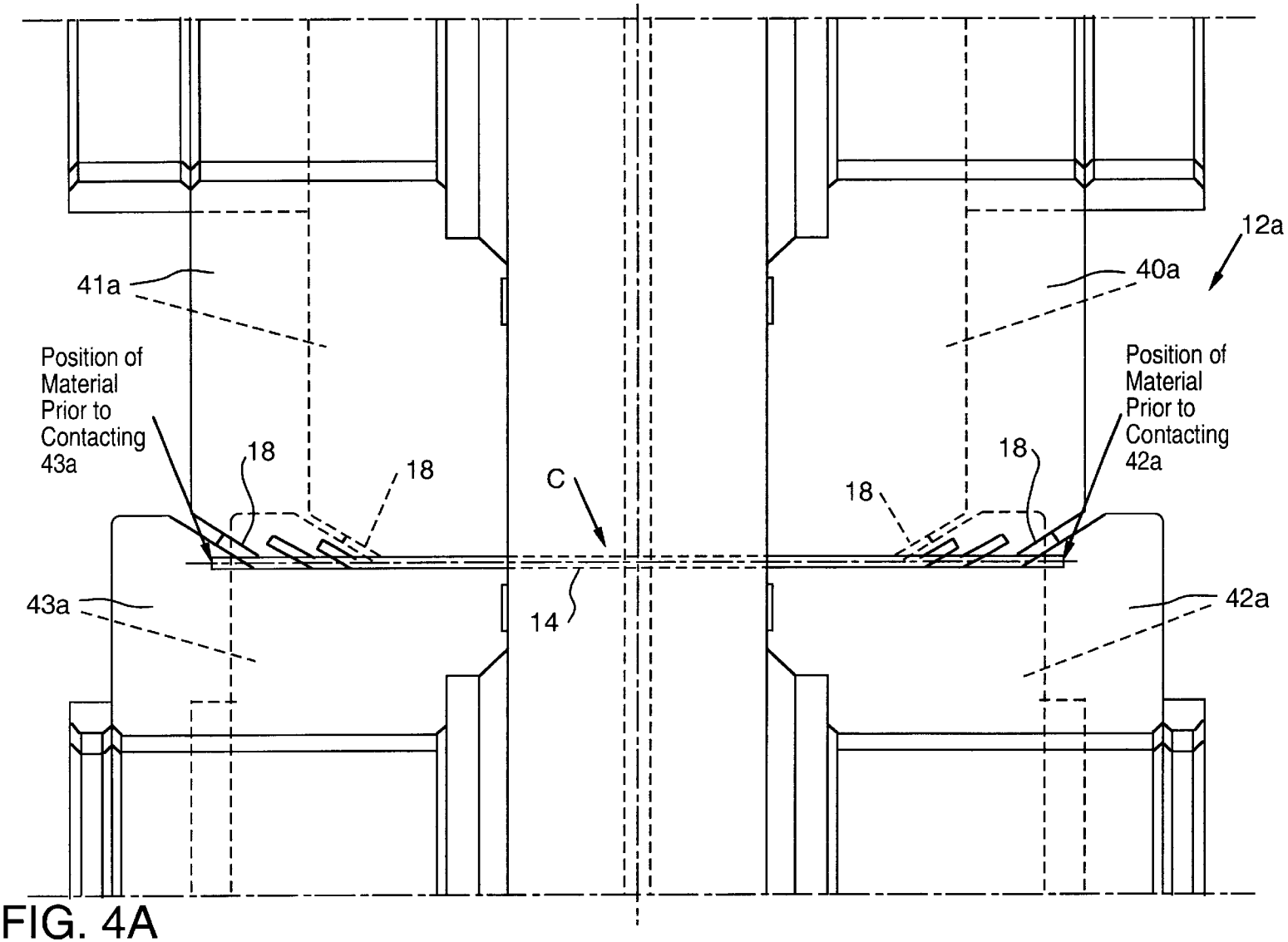
FIGS. 4A–4M are partial front-elevational views of the rollforming stations 12*a*–12*m* of the rollforming machine illustrated in FIG. 1A.

Referring to FIG. 4A, rollforming station 12*a* includes upper forming rolls 40*a* and 41*a* and lower forming rolls 42*a* and 43*a*. Rollforming station 12*a* initiates the formation of the component C by bending the end of the strip of material to begin to form the lips 18. As shown in FIG. 4A and as will be described in more detail herein, the forming rolls 40*a*, 41*a*, 42*a* and 43*a* are laterally adjustable, as shown in dotted line, to accommodate forming components C that have webs 14 of different widths.

Figure 4B:
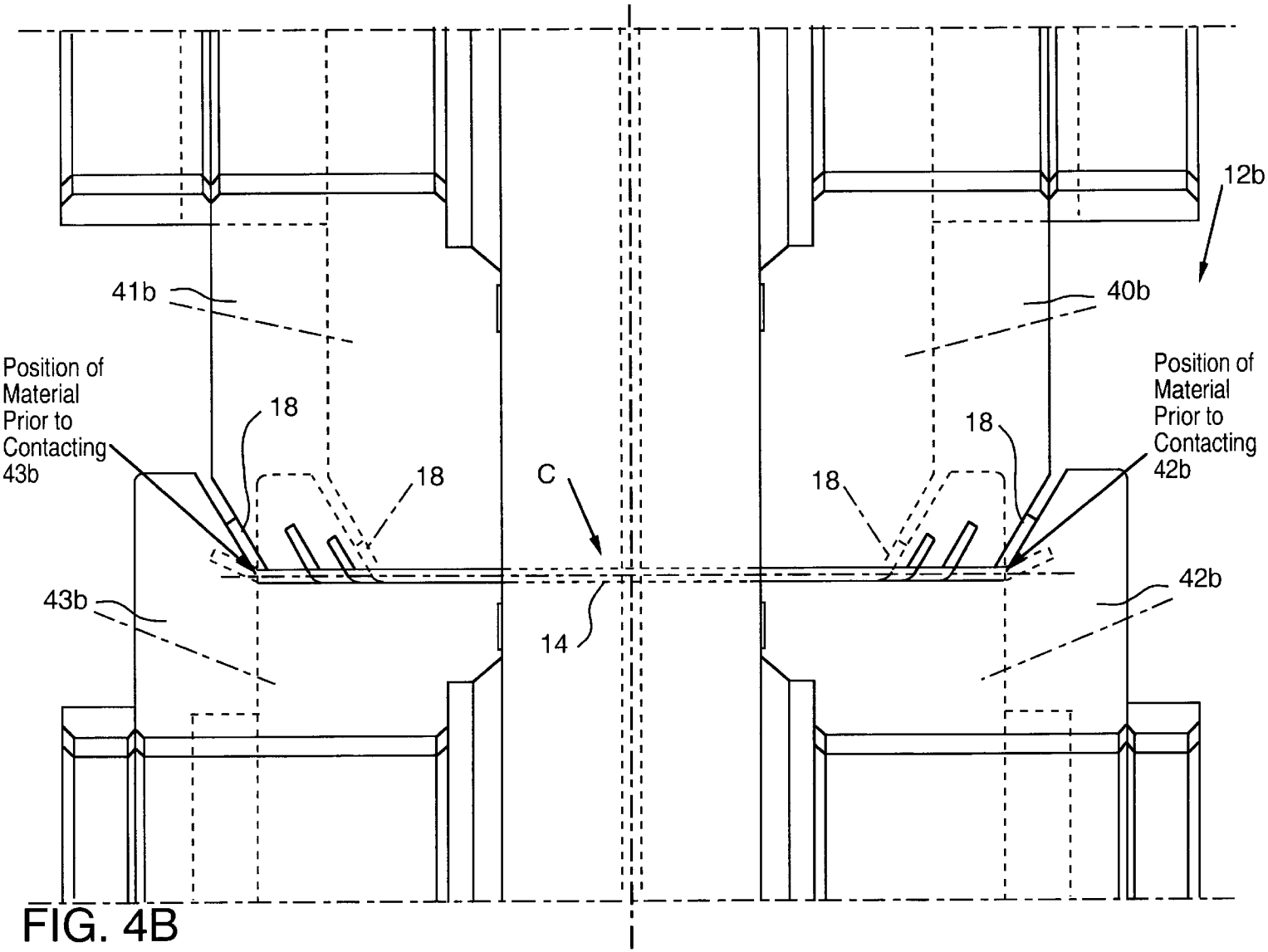

FIG. 4B illustrates rollforming station 12*b* having a pair of upper forming rolls 40*b* and 41*b* and a pair of lower forming rolls 42*b* and 43*b*. Rollforming station 12*b* continues the formation of the lips 18 of the component C.

Figure 4C:
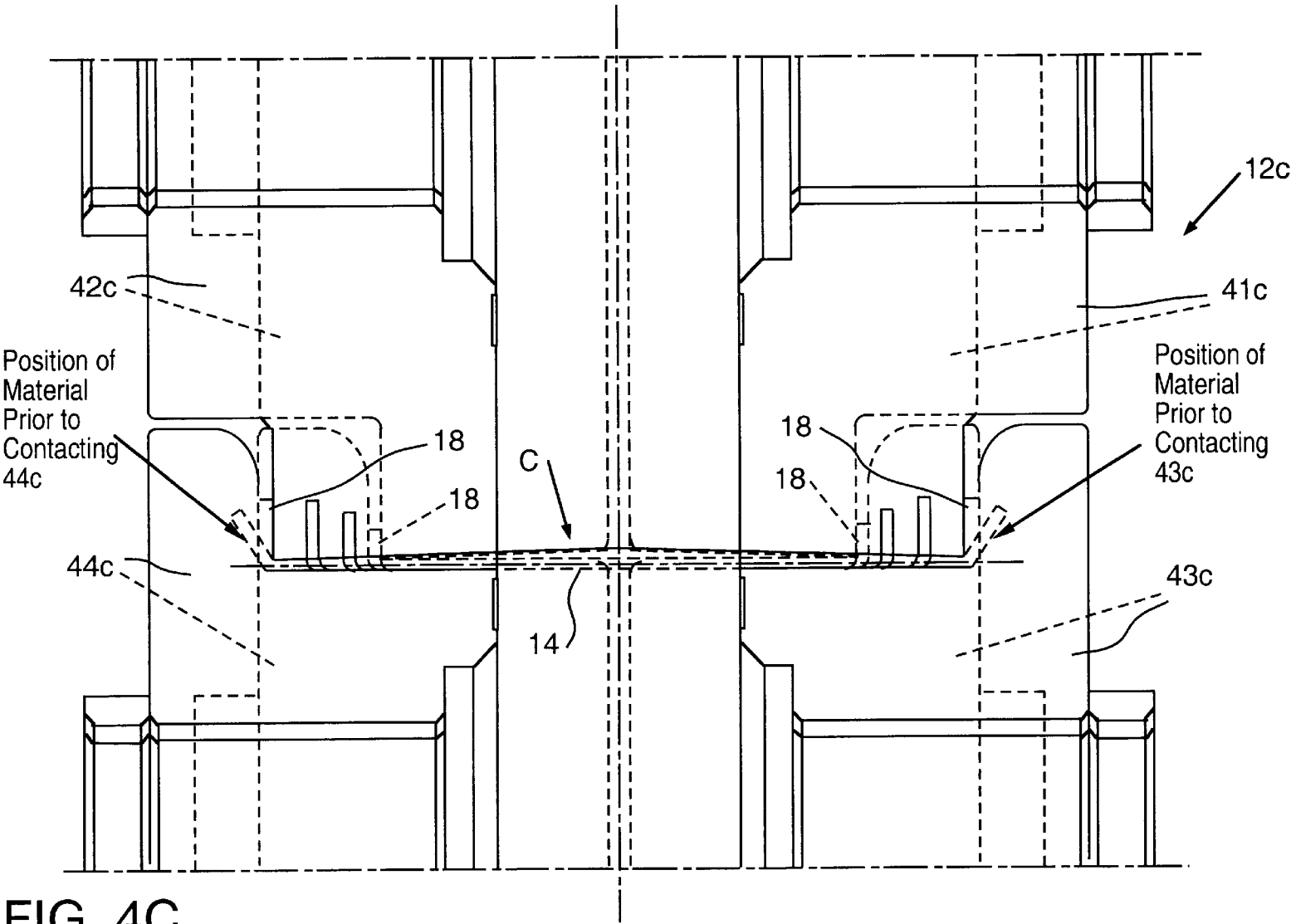
Figure 4D:
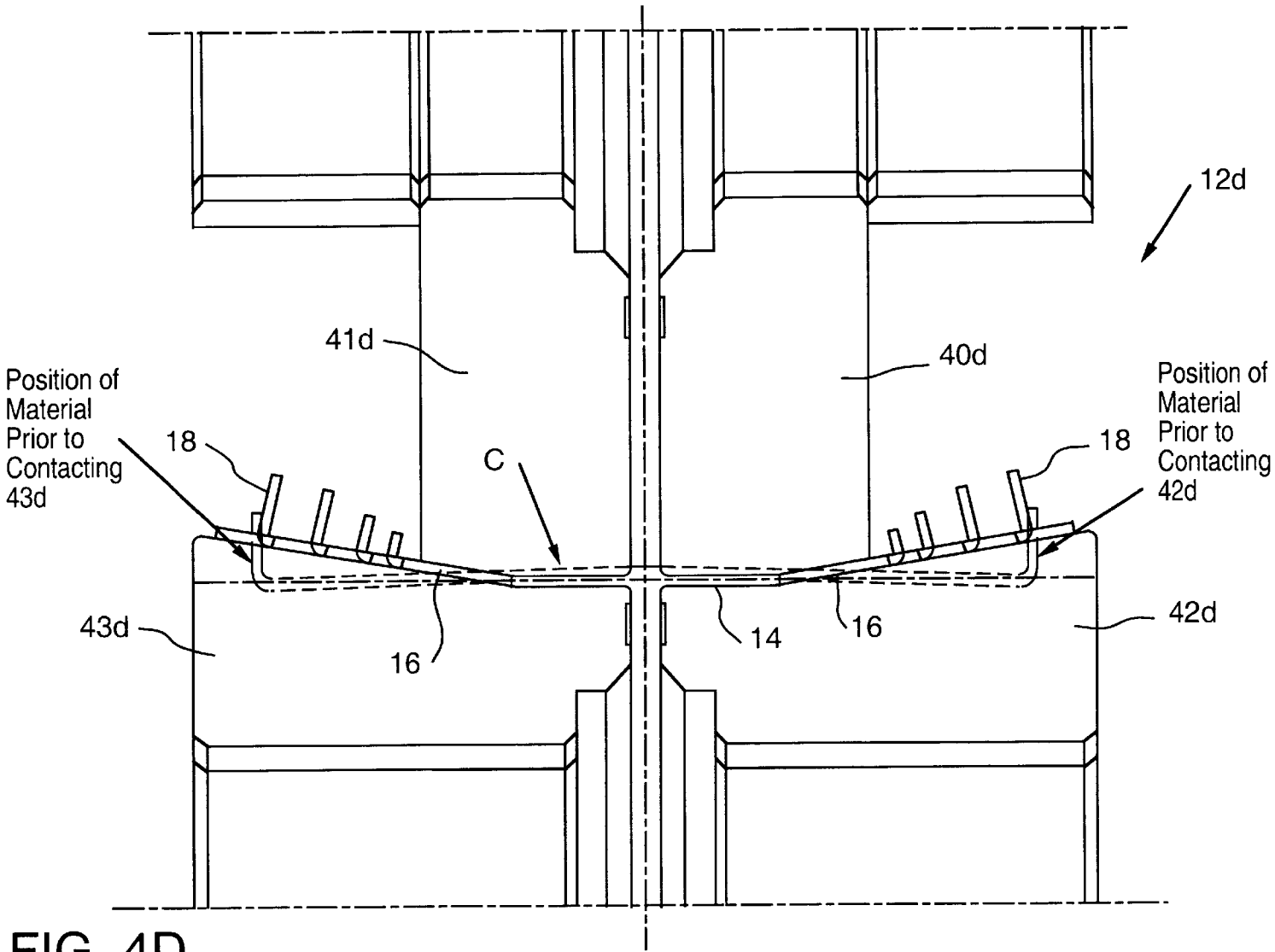
Figure 4E:
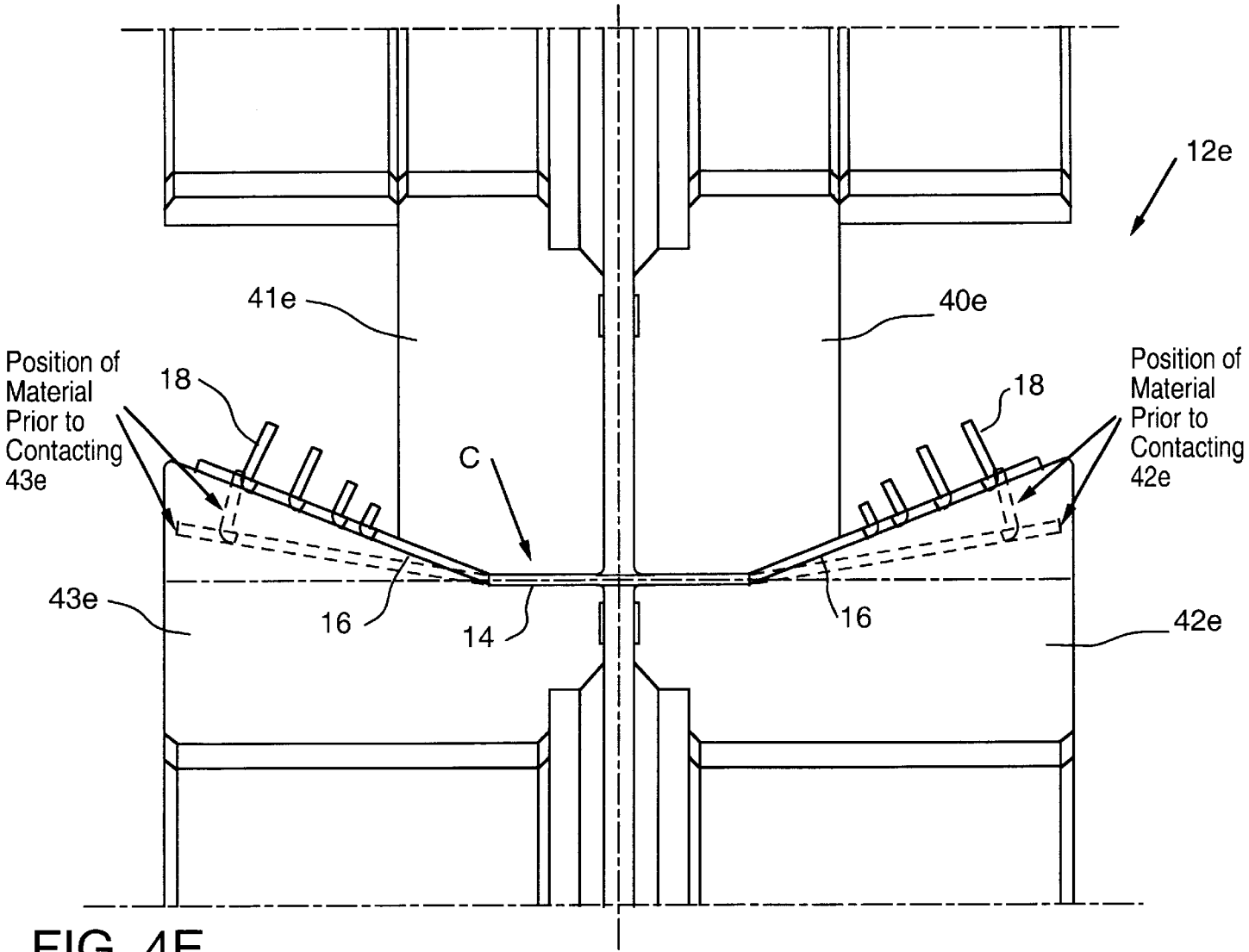
Figure 4F:
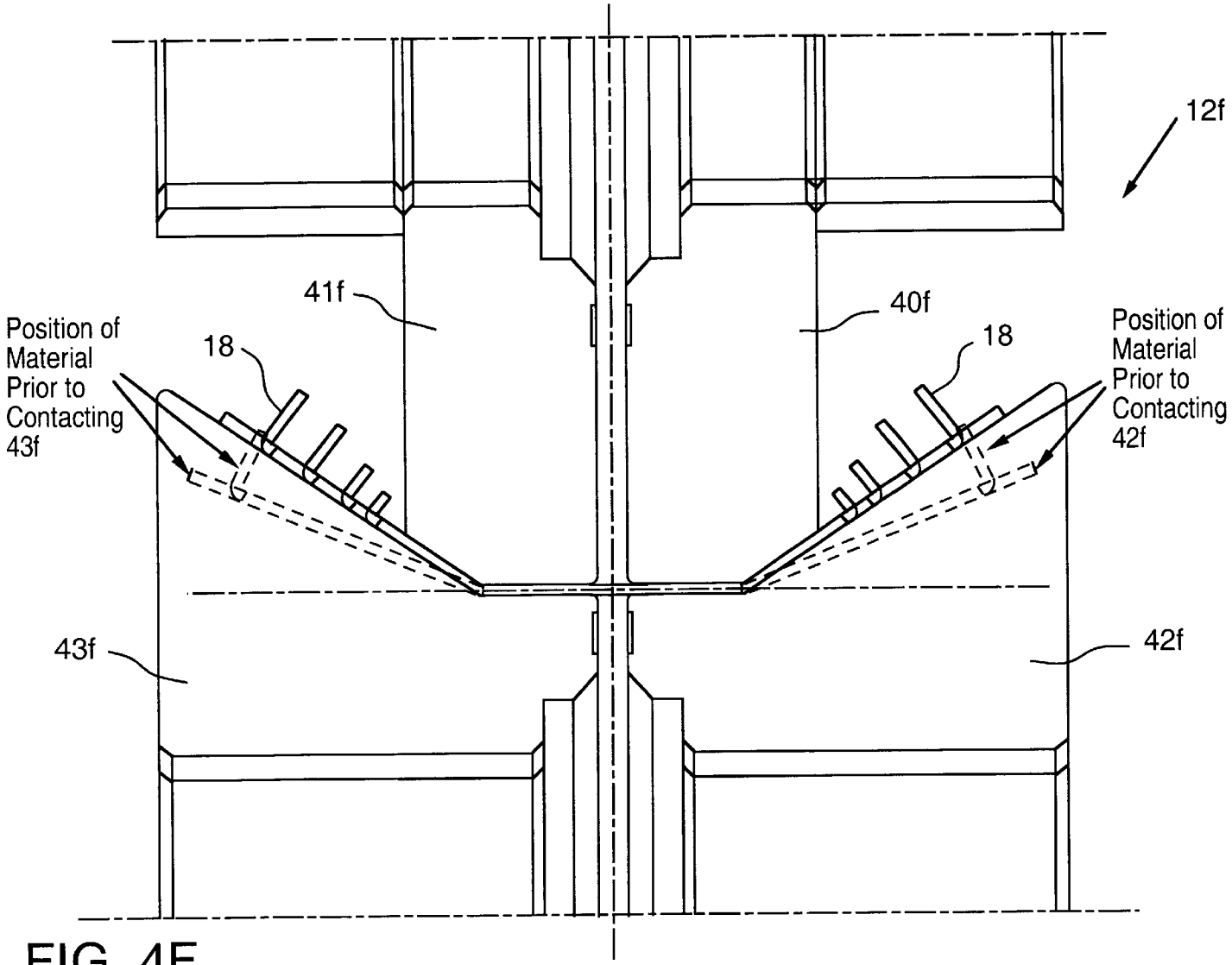
Figure 4G:
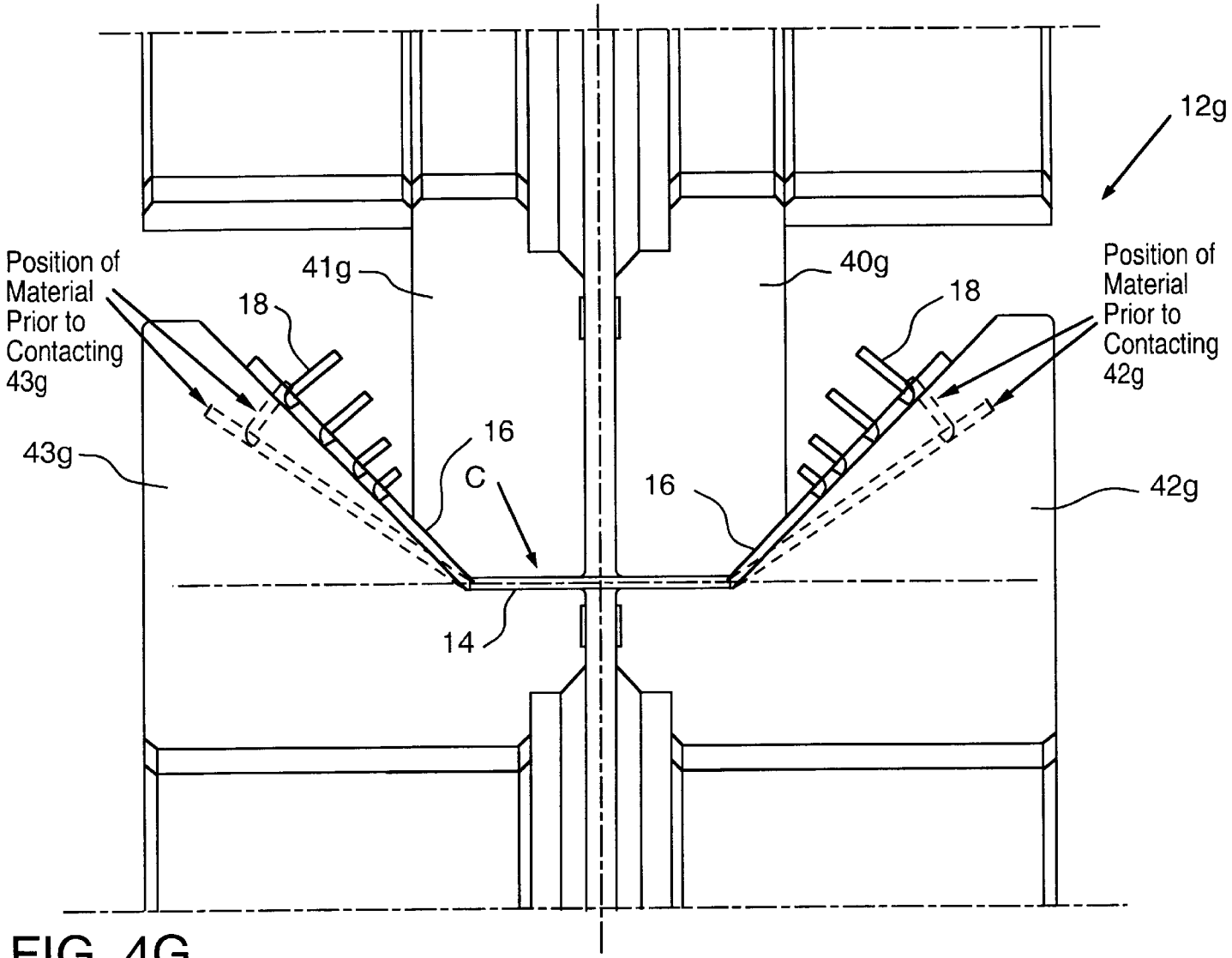
Figure 4H:
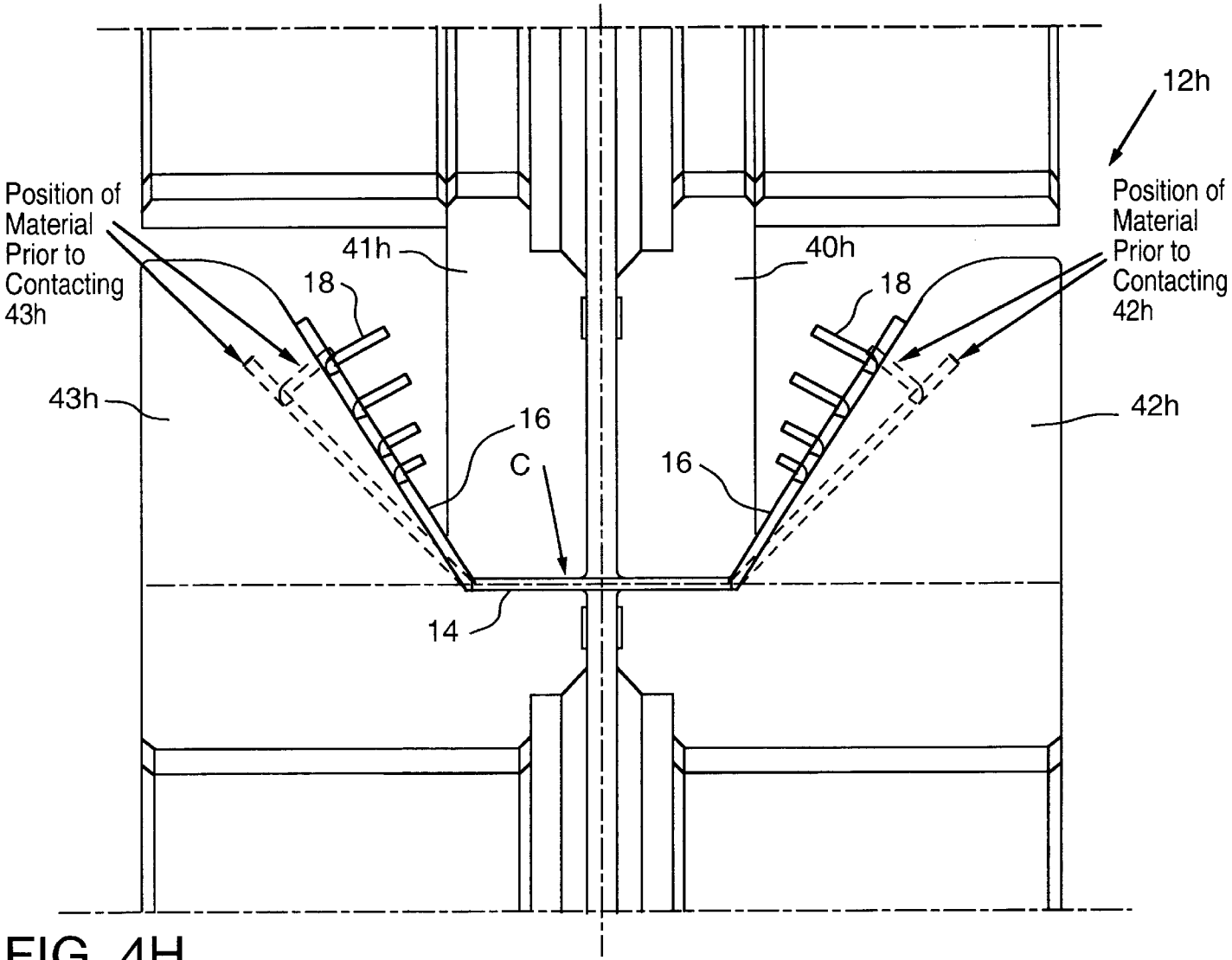
Figure 4I:
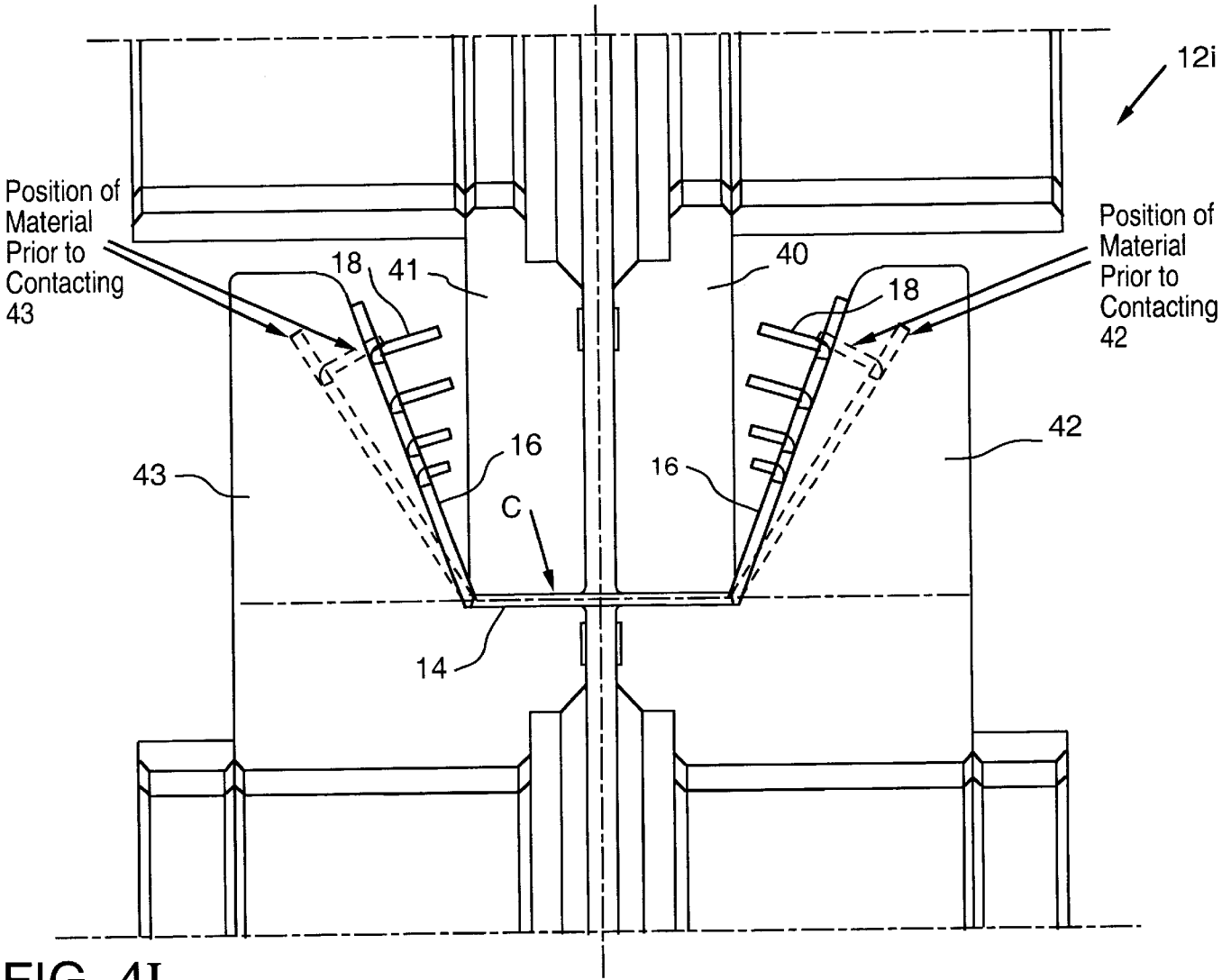
Figure 4J:
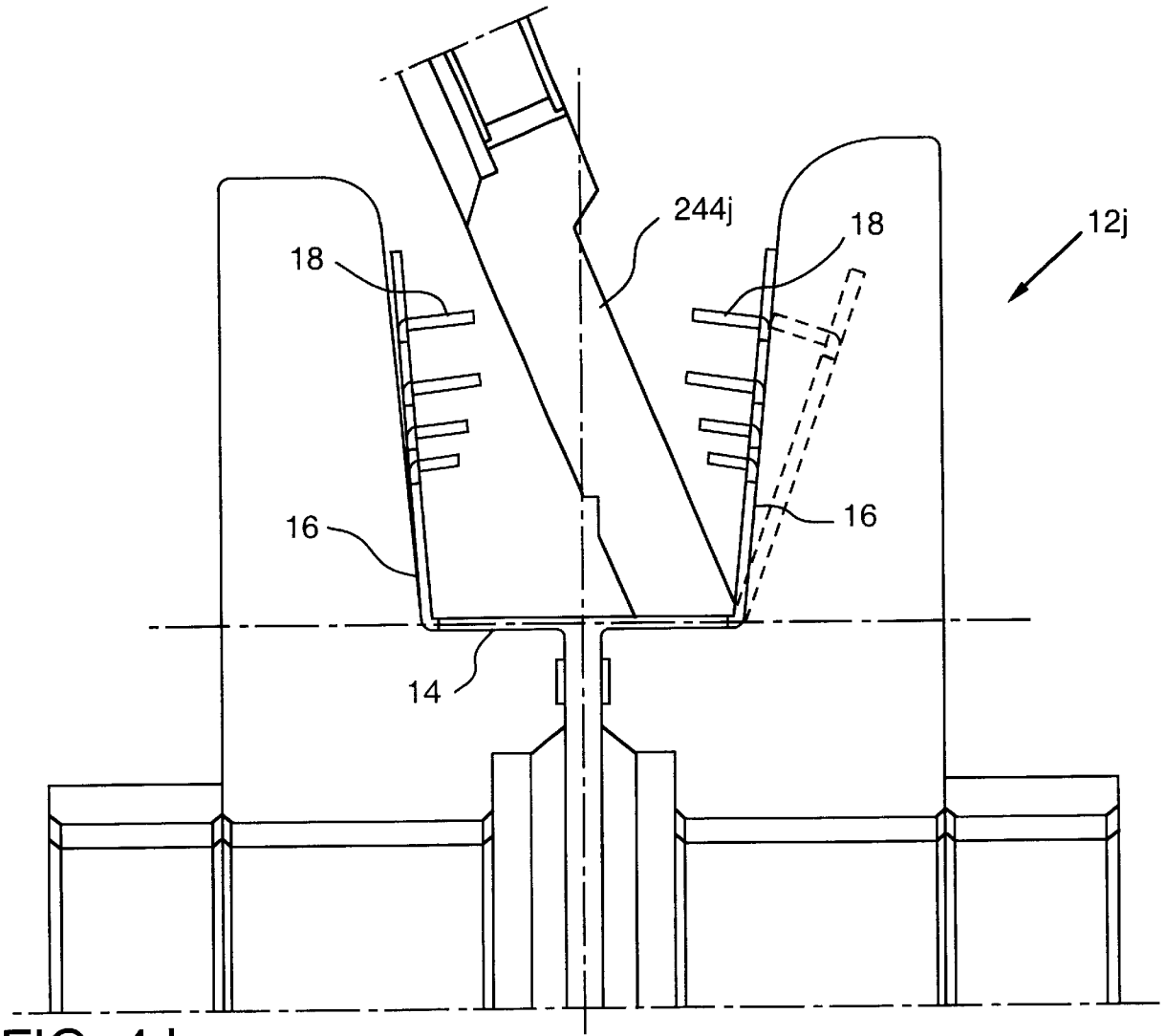
Figure 4K:
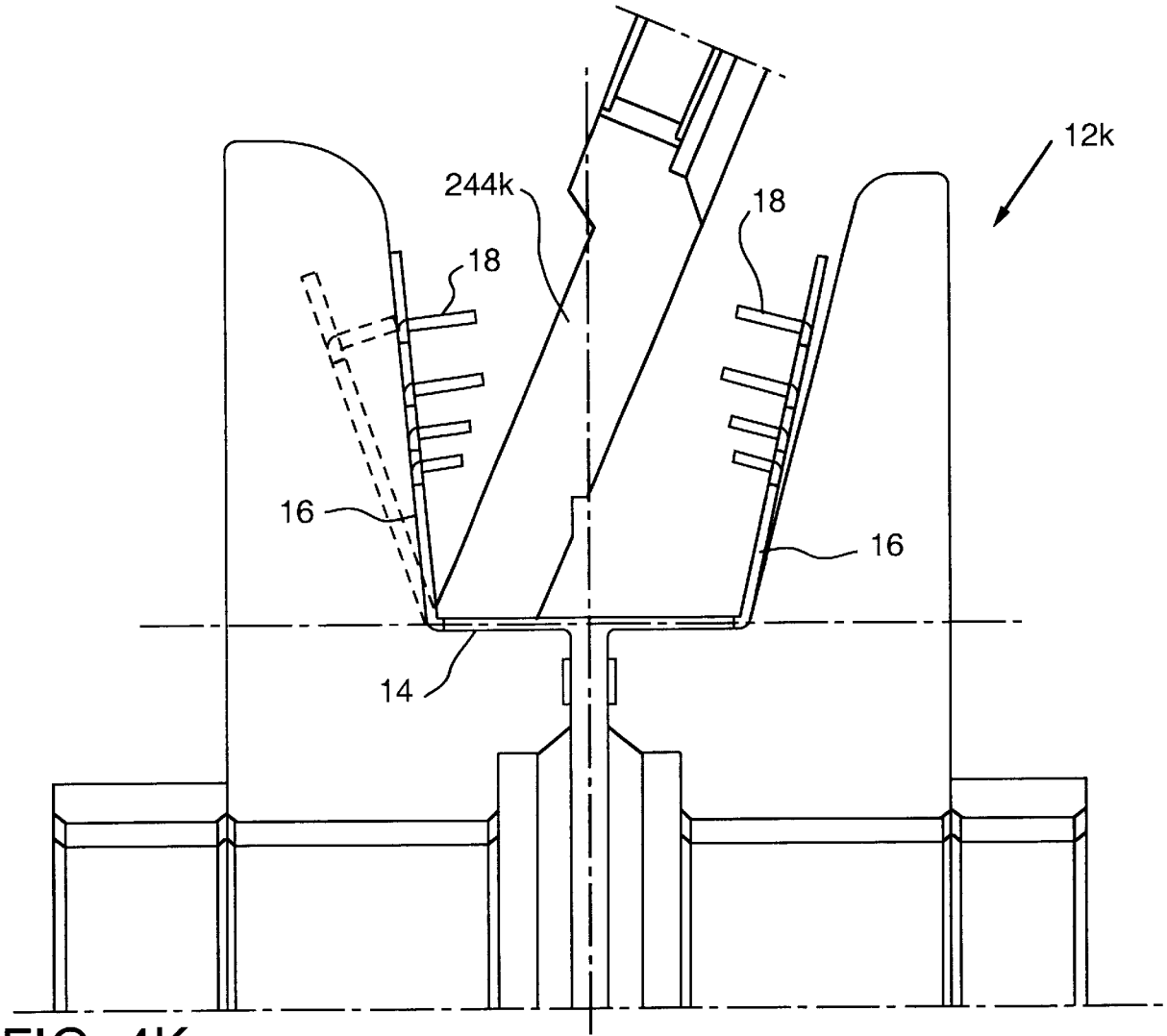
Figure 4L:
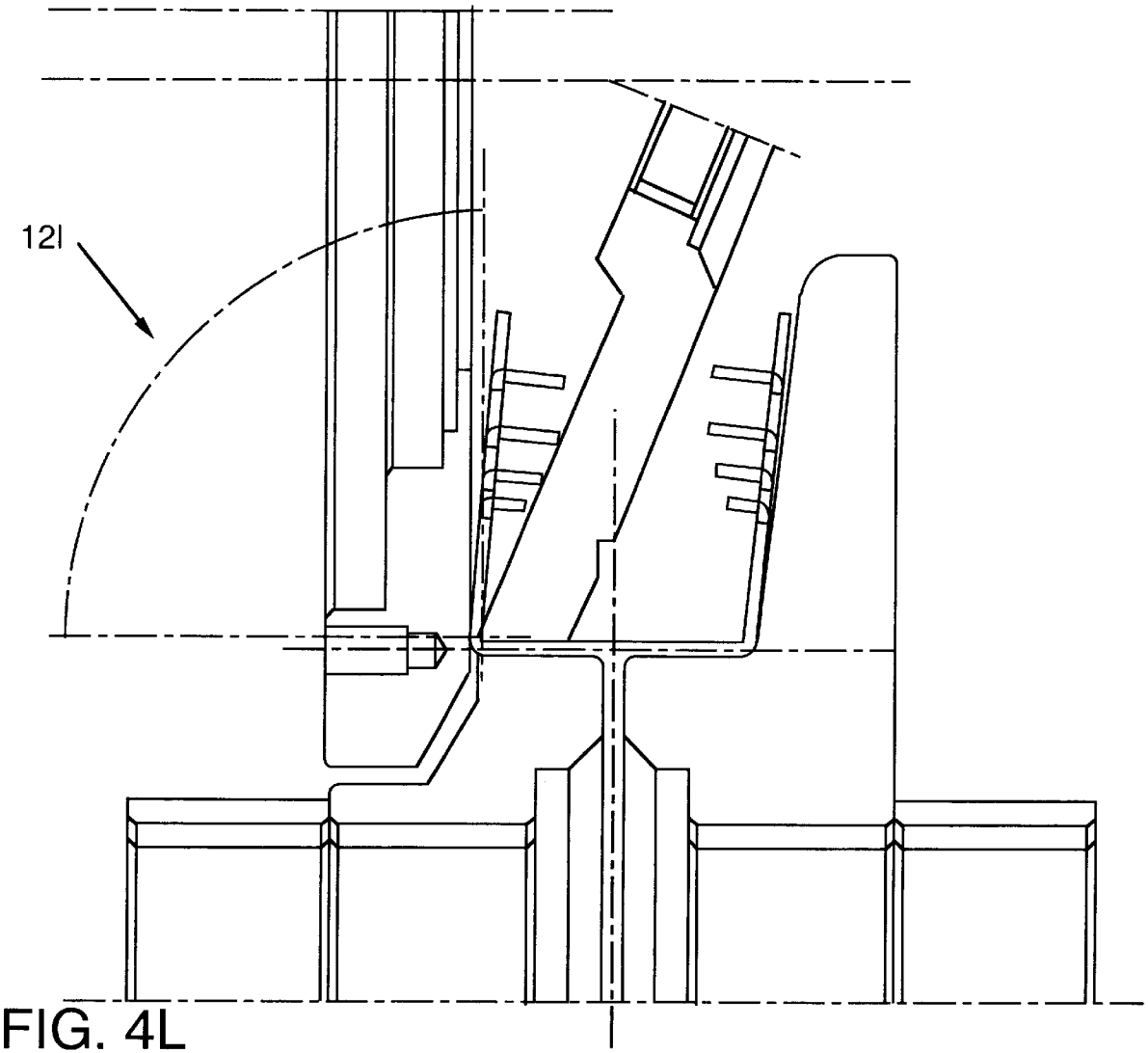
Figure 4M:
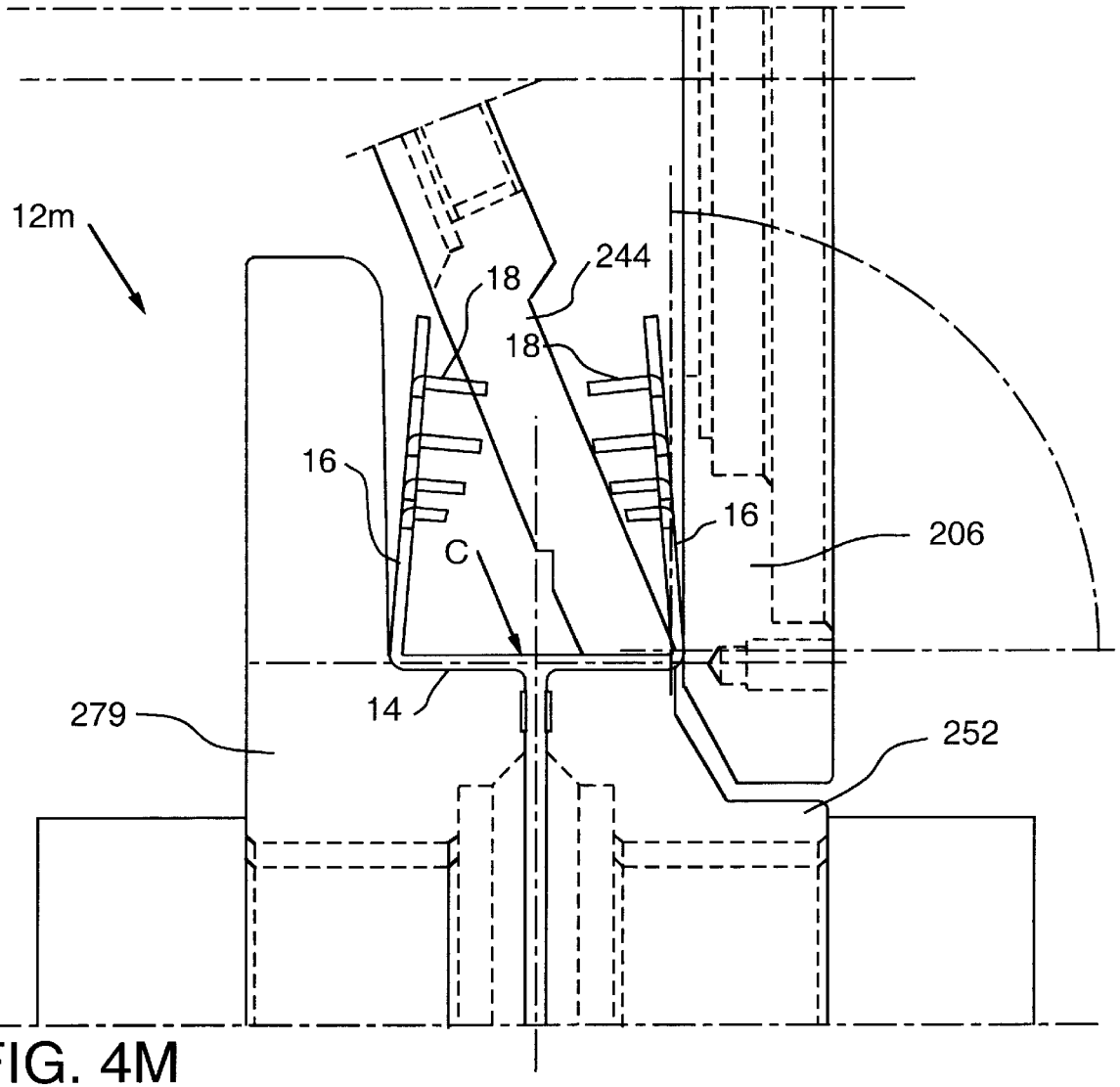

Referring to FIG. 4C, there is illustrated rollforming station 12*c* having a pair of upper forming rolls 41*c* and 42*c* and a pair of lower forming rolls 43*c* and 44*c*. Rollforming station 12*c* completes the formation of the lips 18 of the component C such that the lips 18 are positioned generally perpendicular to the web 14.

Referring to FIGS. 4D–4I, there is illustrated rollforming stations 12*d*–12*i*, respectively. Each of the rollforming stations 12*d*–12*i* include a pair of upper forming rolls and a pair of lower forming rolls configured to form the legs 16 of the component C. The remaining rollforming stations 12*j*–12*m* are illustrated respectively in FIGS. 4J–4M and will be described in more detail herein.

Figure 5:
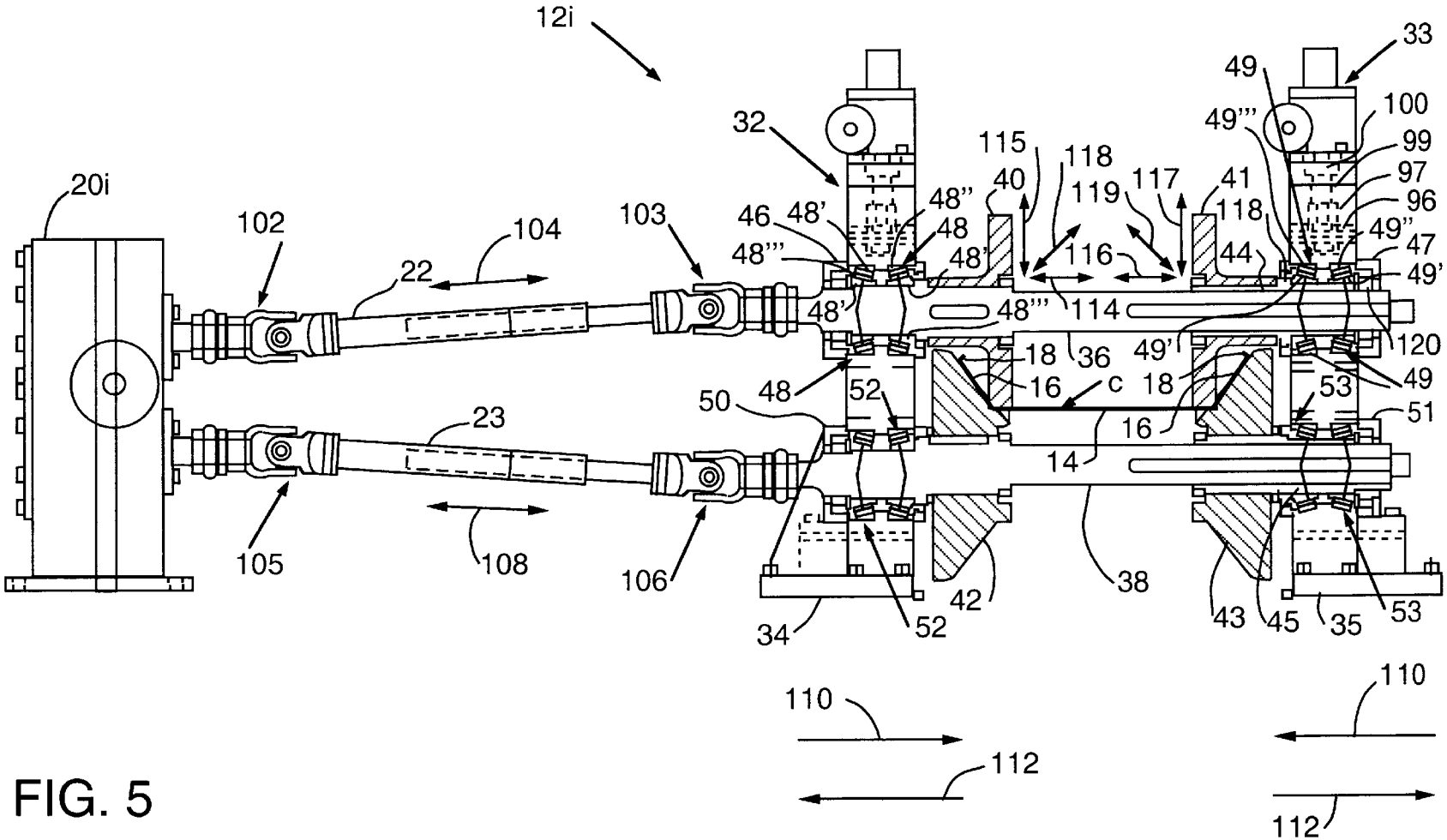
FIG. 5 is a partial sectional view taken along line 5—5 of FIG. 1A.
Figure 6A:
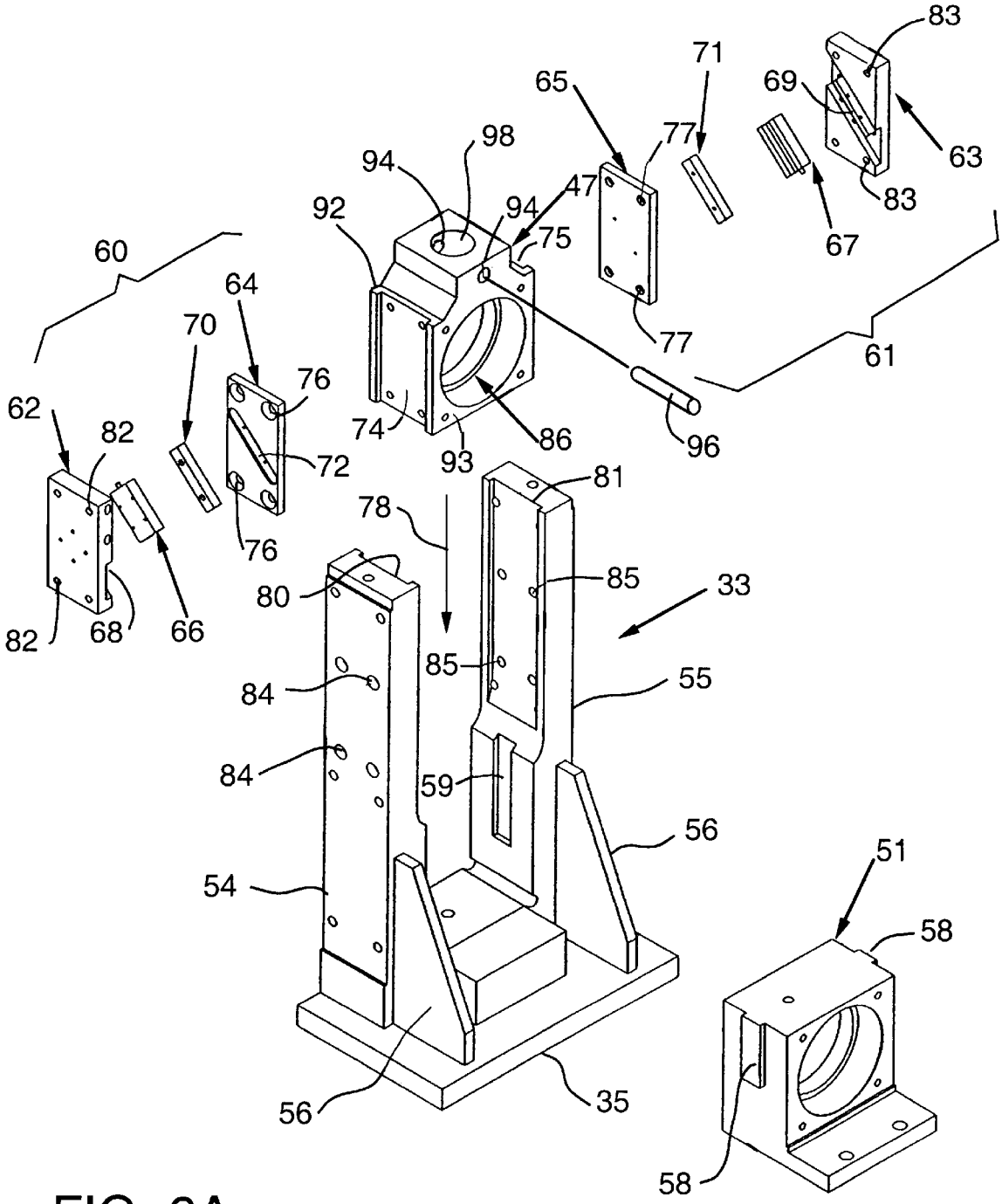
FIG. 6A is an exploded isometric view of a typical support stand, adjustment block and slide assembly in accordance with an embodiment of the invention.
Figure 6B:
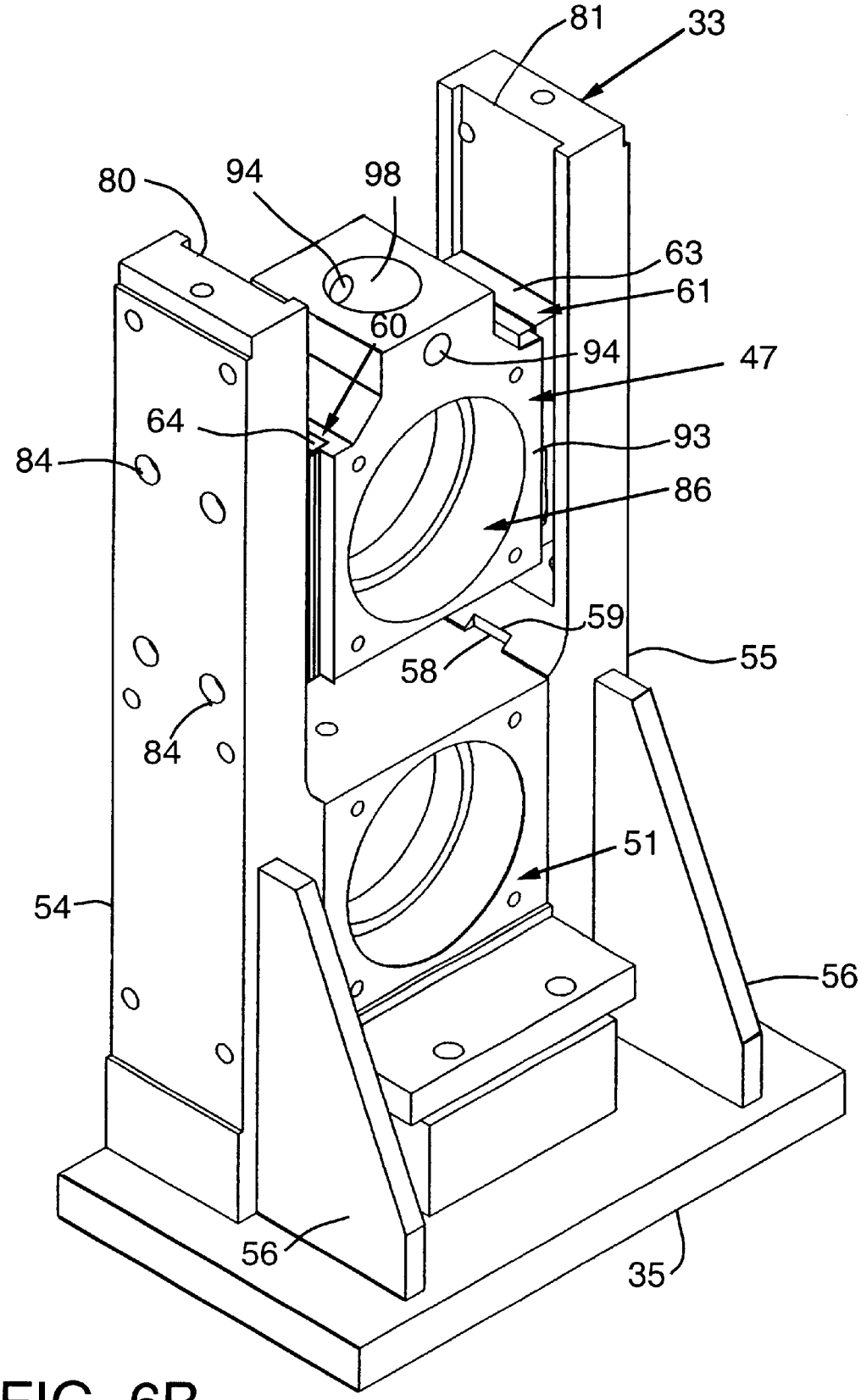
FIG. 6B is an isometric view illustrating the exploded view of FIG. 6A as assembled.
Figure 7:
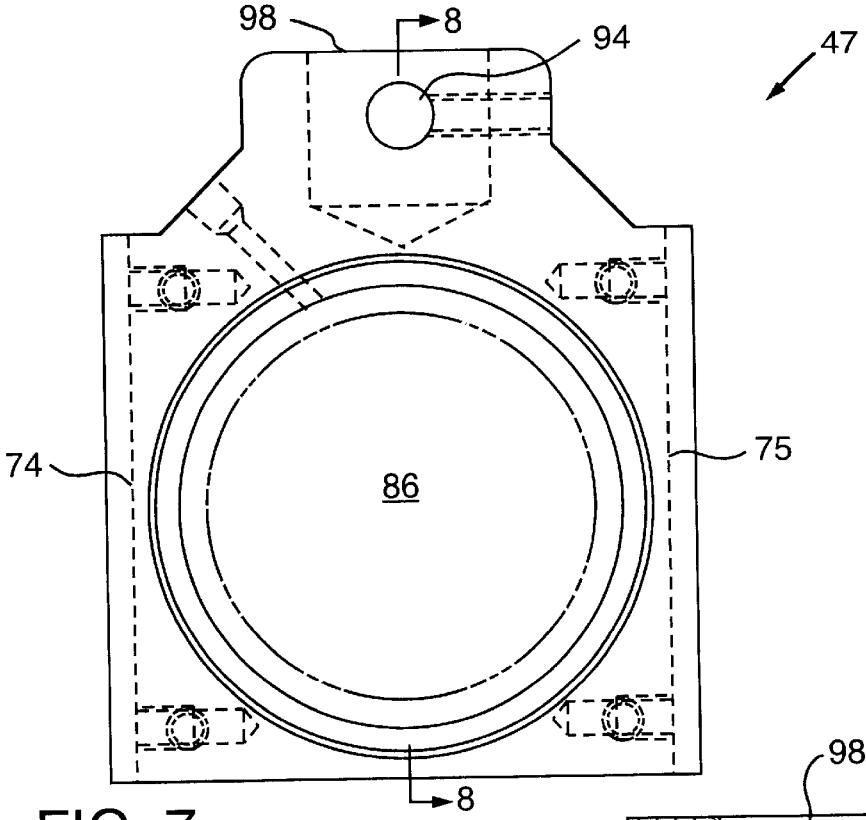
FIG. 7 is a front-elevational view of an embodiment of an adjustment block of the invention.

Referring to FIG. 5, there is illustrated a view of rollforming station 12*i*. Rollforming station 12*i* is typical of the preceding rollforming stations 12*a*–12*h*. It will be appreciated, as explained in detail herein and illustrated in FIGS. 4A–4H, that each of the preceding rollforming stations 12*a*–12*h* include differently configured forming rolls in order to progressively form a specific portion of the component C.

Still referring to FIG. 5, the rollforming station 12*i* (for purposes of simplification of the description of rollforming station 12*i*, the suffix "i" will not be repeatedly used herein but may be shown in the drawings) includes a pair of support stands 32 and 33 each having a base 34 and 35, respectively, for connecting the support stands 32 and 33 to the support frames 24 and 25 (shown in FIG. 1) of the rollforming machine 10. An upper spindle 36 and a lower spindle 38 are rotatably secured to the support stands 32 and 33. The upper spindle 36 supports the pair of upper annular forming rolls 40 and 41, while the lower spindle 38 supports the pair of lower annular forming rolls 42 and 43. More particularly, the forming roll 41 is mounted on a sleeve 44 for rotation therewith and the sleeve 44 is moveably connected to the upper spindle 36 for rotation therewith. The sleeve 44, for example, may include a key for cooperating with an elongated keyway formed in the upper spindle 36 to allow for sliding, longitudinal movement between the sleeve 44 and the upper spindle 36. Similarly, the forming roll 43 is mounted on a sleeve 45 for rotation therewith and the sleeve 45 is moveably connected, by the described key and keyway arrangement, for rotation with the lower spindle 38.

As shown in FIG. 5, the upper spindle 36 is rotatably secured to the support stand 32 by an adjustment block 46. The adjustment block 46 includes a pair of spaced apart bearing assemblies 48 that permit the rotatable motion of the upper spindle 36. Similarly, an adjustment block 47 rotatably supports the sleeve 44 which supports the upper spindle 36 therein. The adjustment block 47 includes an additional pair of spaced-apart bearing assemblies 49 that cooperate with the sleeve 44 to allow the rotatable motion thereof. In addition, the lower spindle 38 is rotatably secured to the support stand 33 by an adjustment block 50 having a pair of spaced apart bearing assemblies 52 therein to allow the rotatable motion of the lower spindle 38 relative to the support stand 33. The sleeve 45 and lower spindle 38 are rotatably secured to the support stand 33 by an additional adjustment block 51 having a pair of spaced apart bearing assemblies 53. Each of the bearing assemblies 48, 49, 52 and 53 are essentially identical and, therefore, only bearing assembly 48 will be described in detail. Bearing assembly 48 is, for example, a pair of opposed tapered roller bearings having an inner race or cone 48' that is secured to the spindle 36 for rotation therewith and an outer race or cup 48" that is stationary within the adjustment block 46 with the roller 48'" positioned therebetween. The bearing assembly 48 may be, for example, available from The Timken Company of Canton, Ohio as Part Nos. 47487 and 47420. However, other conventional bearings may be employed.

Referring to FIGS. 6*a*, 6*b*, 7 and 8, there is illustrated in more detail one embodiment of the support stand 33 and the adjustment block 47. The support stand 33 includes a first leg 54 and a second leg 55 extending from the base 35. A pair of structural flanges 56 may be connected to the base 35 and the legs 54 and 55 to provide structural support for the legs 54 and 55. The adjustment block 51 is received in a bottom portion of the support stand between the legs 54 and 55. Specifically, the adjustment block 51 includes tabs 58 for receipt in slots 59 (only one slot 59 shown in FIG. 6*a*) formed on inner, bottom portion of the legs 54 and 55. The adjustment block 47 is received in an upper portion of the support stand 33 between the legs 54 and 55. The adjustment block 51 remains stationary with respect to the support stand 33, while the adjustment block 47 is moveably connected to the support stand 33.

In this embodiment, to provide for the moveable connection of the adjustment block 47 to the support stand 33, there is provided a first slide assembly 60 and a second slide assembly 61. It will be appreciated that the first slide assembly 60 and the second slide assembly 61 are essentially identical. The slide assembly 60 includes an outer gage block 62 and an inner gage block 64. The second slide assembly 61 also includes an outer gage block 63 and an inner gage block 65. The first slide assembly 60 and the second slide assembly 61 each include a bearing member 66 and 67, respectively, that is rigidly secured to the respective outer gage blocks 62 and 63. Specifically, the bearing member 66 is received in a bearing slot 68 and the bearing member 67 is received in a bearing slot 69 and, for example, a plurality of fasteners (not shown) may be utilized for rigidly securing the bearing members 66 and 67 to the outer gage blocks 62 and 63. The first slide assembly 60 further includes a rail member 70 that is received in a rail slot 72 formed on the inner gage block 64. A plurality of fasteners (not shown) may also be provided for rigidly securing the rail member 70 to the inner gage block 64. Similarly, the second slide assembly 61 also includes a rail member 71 received in a rail slot (not shown in FIG. 6*a*).

The first slide assembly 60 is assembled such that the bearing member 66 is in cooperative engagement with the rail member 70 to allow movement therebetween. Similarly, the second slide assembly 61 is assembled such that the bearing member 67 is positioned for cooperative engagement with the rail member 71 to allow movement therebetween. The bearing member 66 and rail member 70 and the bearing member 67 and rail member 71 are commercially available components and may be, for example, a THK Miniature LM Guide Type RSR . . . Z manufactured by THK.

The first slide assembly 60 is mounted to the adjustment block 47 by rigidly securing the inner gage block 64 to a first side 74 of the adjustment block 47 using, for example, a plurality of fasteners (not shown) that extend through the apertures 76 formed in the inner gage block 64. Similarly, the second slide assembly 61 is connected to a second side 75 of the adjustment block 47 by rigidly securing the inner gage block 65 to a second side 75 using, for example, a plurality of fasteners (not shown) that extend through the plurality of apertures 77 formed in the inner gage block 65.

After the first slide assembly 60 and the second slide assembly 61 are mounted to the adjustment block 47, the adjustment block 47 is positioned between the legs 54 and 55 of the support stand 33 in the direction of arrow 78. As shown, the outer gage block 62 is at least partially received in a generally U-shaped receptacle 80 formed in the first leg 54 and the outer gage block 63 is at least partially received in a generally U-shaped receptacle 81 formed in the second leg 55. The outer gage block 62 is positioned such that a plurality of apertures 82 formed in the outer gage block 62 are aligned with a corresponding plurality of apertures 84 formed in the first leg 54. A plurality of fasteners (not shown) extend through the apertures 82 and 84 to rigidly secure the outer gage block 62 to the first leg 54. Similarly, the outer gage block 63 includes a plurality of apertures 83 that are aligned with a corresponding plurality of apertures 85 formed in the second leg 55. A plurality of fasteners (not shown) extend through the apertures 83 and 85 to rigidly secure the outer gage block 63 to the second leg 55 of the support stand 33. As will be appreciated, the described arrangement allows for linear movement of the adjustment block 47 in an angled direction, and specifically in a direction corresponding to an angle at which the bearing members 66 and 67 are in cooperative engagement with the rail members 70 and 71 for movement therebetween, as will be described in more detail herein.

Figure 8:
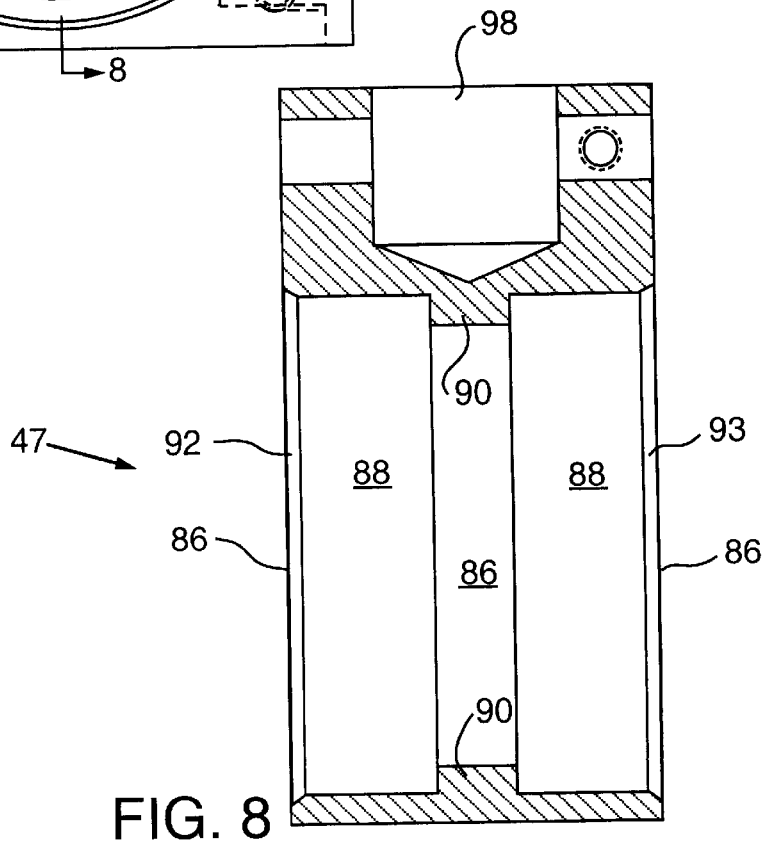
FIG. 8 is a sectional view taken along line 8—8 of FIG. 7.
Figure 9:
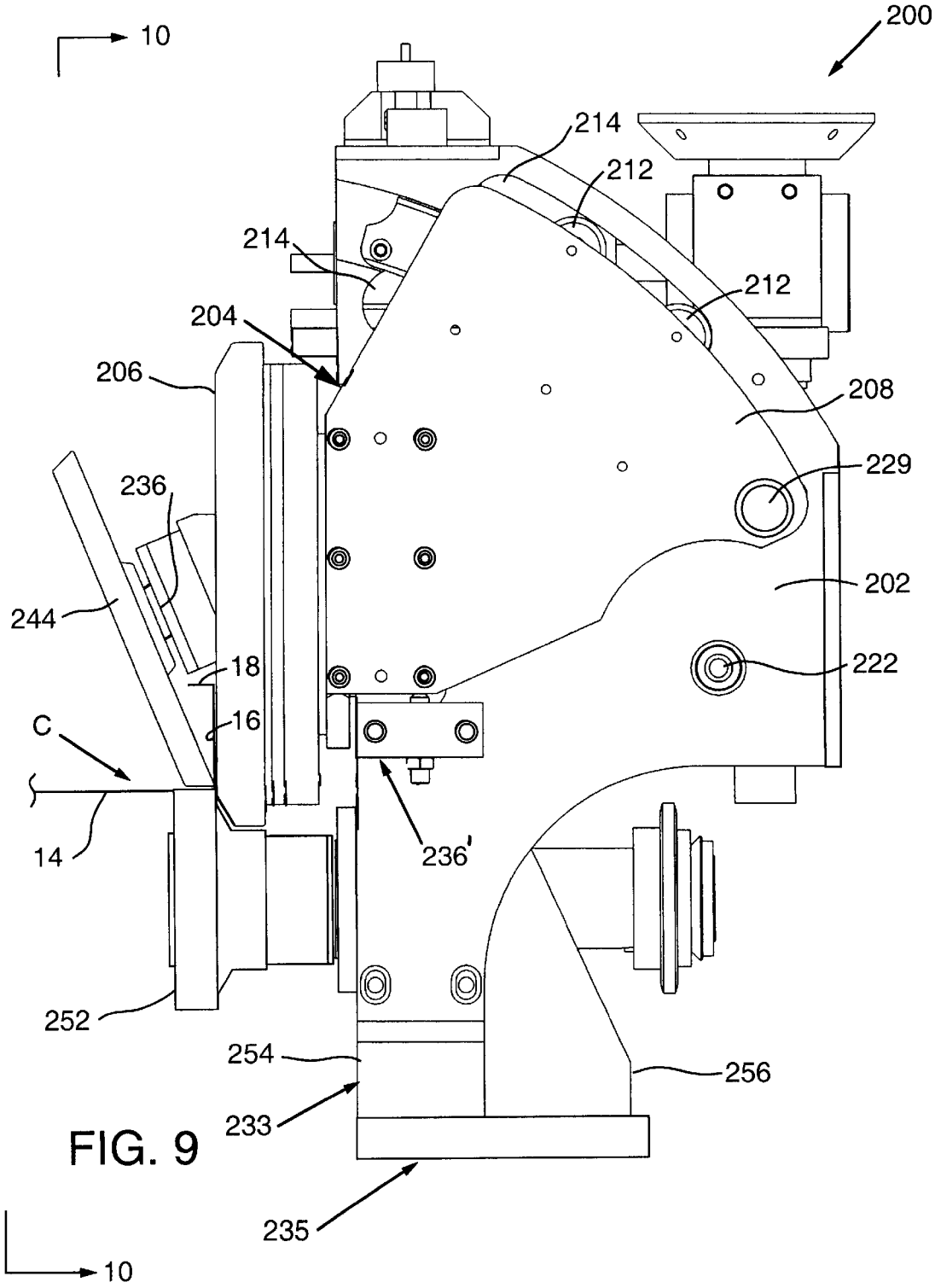
FIG. 9 is a side-elevational view of a rollforming apparatus employed at, for example, rollforming stations 12-*l* and/or 12*m* of the rollforming machine shown in FIG. 1A.

Referring to FIGS. 6*a*, 6*b*, 7 and 8, the adjustment block 47 will be described in more detail. It will be appreciated that the adjustment block 48 is essentially identical to the adjustment block 47. As previously described, the adjustment block 47 includes a first side 74 for attaching the inner gage block 64 thereto and a second side 75 for attaching the inner gage block 65 thereto. The adjustment block 47 also includes a central opening 86 extending therethrough. The opening 86 is generally circular for receipt of the sleeve 44 and the upper spindle 36 therein, or in the case of the adjustment block 48 for receipt of the upper spindle 36 only therein. As best shown in FIG. 8, the adjustment block 47 includes bearing pockets 88 for receipt of the bearing assemblies 49. The bearing assemblies 49, as previously described, rotatably secure the sleeve 44 and upper spindle 36 to the support stand 33. The adjustment block 47 includes an annular bearing support 90 positioned between and about the bearing pockets 88 in order to maintain the position of the bearing assemblies 49 within the bearing pockets 88. The adjustment block 47 also includes an inner bearing plate 92 and an outer bearing plate 93 for further securing and maintaining the bearing assemblies 49 in the bearing pockets 88.

In addition, the adjustment block 47 includes an opening 94 therethrough for receiving a clevis pin 96. The adjustment block 47 also includes an additional opening 98 that extends generally transverse to the opening 94. A clevis with bushing 97 extends into the opening 98 and is slideably connected at one end to the clevis pin 96 and at the other end is attached to a shaft 99 (see FIG. 5 and FIG. 10) of a screw jack assembly 100 which provides a driving movement to the adjustment block 47, as will be described in more detail herein.

Figure 2:
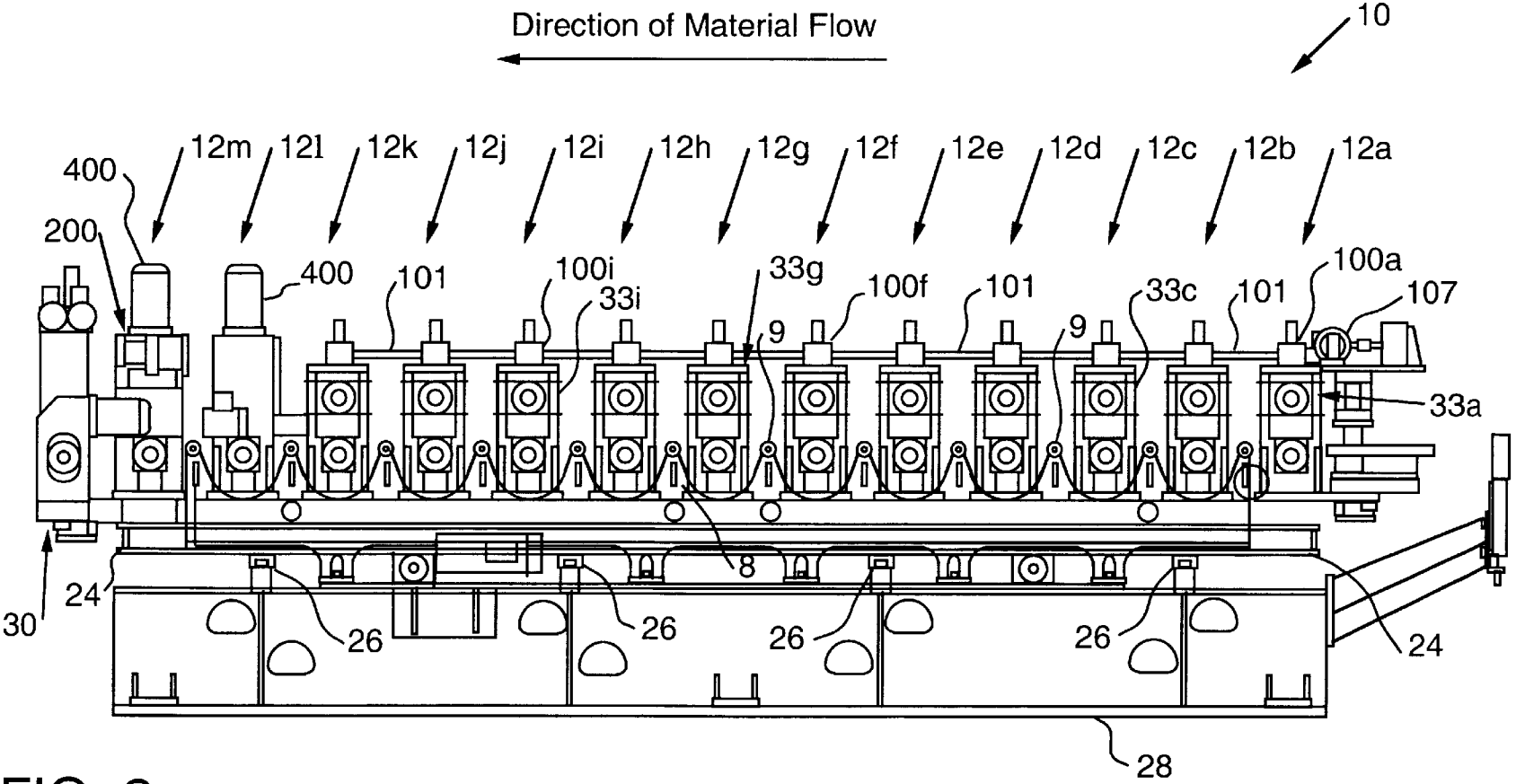
FIG. 2 is a side-elevational view taken along line 2—2 of FIG. 1A.

As shown in FIGS. 1A and 2, each rollforming station 12*a*–12*k* includes a screw jack assembly 100*a*–100*k* that are interconnected by linkage arrangements 101. The linkage arrangements 101 are in turn connected to a drive motor 107 to actuate each of the individual screw jack assemblies for operation of the adjustment blocks, as described herein. Rollforming stations 12-*l* and 12*m* include drive motors 400 for actuating the adjustment block that controls movement of the angled roll 244.

Referring to FIGS. 1A and 5, the transmission 20 is connected to an upper drive shaft 22 by a conventional universal coupling, generally designated by reference number 102, and the upper drive shaft 22 is connected to the upper spindle 36 by an additional universal coupling, generally designated by reference number 103. The described arrangement provides for rotation of the upper spindle 36. The upper drive shaft 22 is a telescoping type drive shaft to allow for the individual segments of the drive shaft 22 to telescope in the directions indicated by arrow 104. Such drive shafts are well known components. Similarly, drive shaft 23 is connected to the transmission 20 by a universal coupling 105 and the lower spindle 38 is connected to the lower drive shaft 23 by additional universal coupling 106. The lower drive shaft 23 is also a telescoping type for movement in the directions indicated by arrow 108.

The support stands 32 and 33 may be simultaneously adjusted in an inward direction, as indicated by arrows 110 or may be simultaneously adjusted in an outward direction as indicated by arrows 112 in order for the rollforming machine 10 to accommodate a component C having a web 14 of different widths. The movement of the support stands 32 and 33 is accomplished by simultaneously moving the support frames 24 and 25, to which the support stands 33 and 32 are respectively connected, in the direction of arrows 110 or arrows 112. During movement of the support stands 32 and 33, the transmission **20*i* remains stationary. Movement of the support stand 32 in the inward direction of arrow 110 results in the expansion or extension of the drive shafts 22 and 23 because the upper spindle 36 and lower spindle 38 are rotatably secured to the support stand 32 by respective adjustment blocks 46 and 50, and more specifically by the pairs of bearing assemblies 48 and 52. During inward movement of the support stand 33, the sleeves 44 and 45, which are rotatably secured to respective adjustment blocks 47 and 51, also move inward with respect to the upper spindle 36 and lower spindle 38. As previously described, the sleeve 44 is moveably connected to the upper spindle 36 by a key and keyway arrangement and similarly the sleeve 45 is moveably connected to the lower spindle 38 by a key and keyway arrangement. The inward movement of the spindles 36 and 38 results in the inward movement of forming rolls 40 and 42 and the inward movement of sleeves 44 and 45 results in the inward movement of forming rolls 41 and 43**.

During outward movement of the support stand 32 as, indicated by arrow 112, the drive shafts 22 and 23 collapse in order to accommodate the outward movement. In addition, outward movement of the support stand 33, as indicated by arrow 112, results in the sleeve 44 moving with respect to the upper spindle 36 and the sleeve 45 moving with respect to the lower spindle 38. The described movement results in outward movement of the forming rolls 40, 41, 42 and 43.

In addition to adjusting the rollforming stations 32 and 33 inwardly and outwardly for a component C having a web 14 of different widths, the invention includes adjusting the forming rolls 40 and 41 relative to the forming rolls 42 and 43, respectively, to accommodate forming a component C of a material having different thicknesses or different gauges. To make the necessary adjustments for materials of different thicknesses, it is necessary to adjust each of the forming rolls 40 and 41 in two different planes. Specifically, it is necessary to adjust the forming roll 40 in the direction of an axis of rotation of the upper spindle 36, as indicated by arrow 114, and in a direction transversely to the axis of rotation of the upper spindle 36, as indicated by arrow 115. Similarly, it is necessary to adjust forming roll 41 axially in the direction of an axis of rotation of the upper spindle 36, as indicated by arrow 116, and in a direction of transversely to the axis of rotation of the upper spindle 36, as indicated by arrow 117. Advantageously, the previously described arrangements of adjustment blocks 46 and 47 each having the first slide assembly 60 and second slide assembly 61, allows for one continuous movement of the forming roll 40 in the direction of arrow 118 and for one continuous movement of the forming roll 41 in the direction of arrow 119. As can be appreciated, the direction of arrow 118 is in a direction that is the resultant of the axial component 114 and the normal component 115 of motion of upper spindle 36, as illustrated in FIG. 5. Likewise, the direction of arrow 119 is in a direction that is the resultant of the axial component 116 and the normal component 117 of motion of the upper spindle 36, as illustrated in FIG. 5. It will be appreciated that the direction of arrow 119 is essentially along the same line of action as movement between the bearing member 66 and rail member 70 of the first slide assembly 60 and the bearing member 67 and rail member 71 of the second slide assembly 61. To achieve adjustment of the forming rolls 40 and 41 in two planes for materials of different thicknesses while maintaining equal axial and transverse movement, the direction of arrows 118 and 119 should be generally 45 degrees with respect to the horizontal or the axial components 114 and 116. However, it should be appreciated that the angular position of the arrows 118 and 119 may be at any desired angle by altering the position of the bearing members 66 and 67 and rail members 70 and 71 of the first slide assembly 60 and the second slide assembly 61.

The structural arrangement of support stand 33 in order to achieve the adjustment of forming roll 41 in the direction of arrow 119 will now be described in more detail. It will be appreciated that the structural arrangement of support stand 32 is similar to support stand 33 and that operation of the same to achieve adjustment of forming roll 40 in the direction of arrow 118 is essentially the same. As previously described, support stand 33 includes a screw jack assembly 100, which is a generally well known component. The screw jack assembly 100 includes the shaft 99 that is connected to the clevis with bushing 97 which in turn is moveably connected to the dowel pin 96 which is supported in the aperture 94 of the adjustment block 47. The screw jack assembly 100 is preferably rigidly mounted to the support stand 33. Actuation of the screw jack assembly 100 in a generally upward direction results in the shaft 99 moving the clevis with bushing 97 in a generally upward direction as well. As a result of this upward movement of the screw jack 100 and clevis with bushing 97, the adjustment block 47 must also move as a result of the slideable connection between the clevis with bushing 97 and the clevis pin 96. The resulting movement of the adjustment block 47 is in the direction of arrow 119. This movement results from the relative movement between the bearing member 66 and rail member 70 and the relative movement between the bearing member 67 and the rail member 71. The rail members 70 and 71, which are rigidly secured to the inner gage blocks 64 and 65, respectively, which are in turn rigidly secured to the adjustment block 47, move with respect to the bearing members 66 and 67 in the direction of arrow 119. Because of the described structural arrangement, this is the only direction in which the adjustment block 47 can move in response to actuation of the screw jack assembly 100. Actuation of the screw jack assembly 100 in the opposite direction, i.e., a generally downward direction, will result in movement of the adjustment block 47 in the angular orientation of arrow 117, only in the opposite direction from the previously described movement. Accordingly, actuation of the screw jack assembly 100 in a generally upward direction will result in adjustment of the forming roll 41 in a direction for materials having a greater thickness while actuation of the screw jack assembly 100 in a generally downward direction will result in adjustment of the forming roll 41 in a direction for materials having a lesser thickness.

During movement of the adjustment block 47, one of the bearing assemblies 49, and specifically the inner race or cup 49' thereof, acts against a first shoulder 118 formed on the sleeve 44 and the other bearing assembly 49, and specifically the other inner race or cup 49' thereof, acts against a bearing nut 120 attached to the sleeve 44. The action of the bearing assemblies 49 against the shoulder 118 and bearing nut 120 causes the sleeve 44, which has the forming roll 41 attached thereto, to move in the desired direction with respect to the upper spindle 36.

Rollforming stations 12–*l* and 12*m*, as will be described in detail herein, provide for both rollforming of the component C and overbending of the component C to compensate for springback that may develop during the rollforming process. In this embodiment, rollforming stations 12-*l* and 12*m* are essentially identical except that the rollforming apparatus 200 at each of the stations is located on opposite sides of the rollforming line. Referring to FIGS. 9–19, a rollforming apparatus 200 of this embodiment employed by rollforming stations 12-*l* and 12*m* will be described in detail (for purposes of simplification of the description, the suffixes "l" or "m" will not be repeated herein, but may be shown in the drawings).

Figure 11:
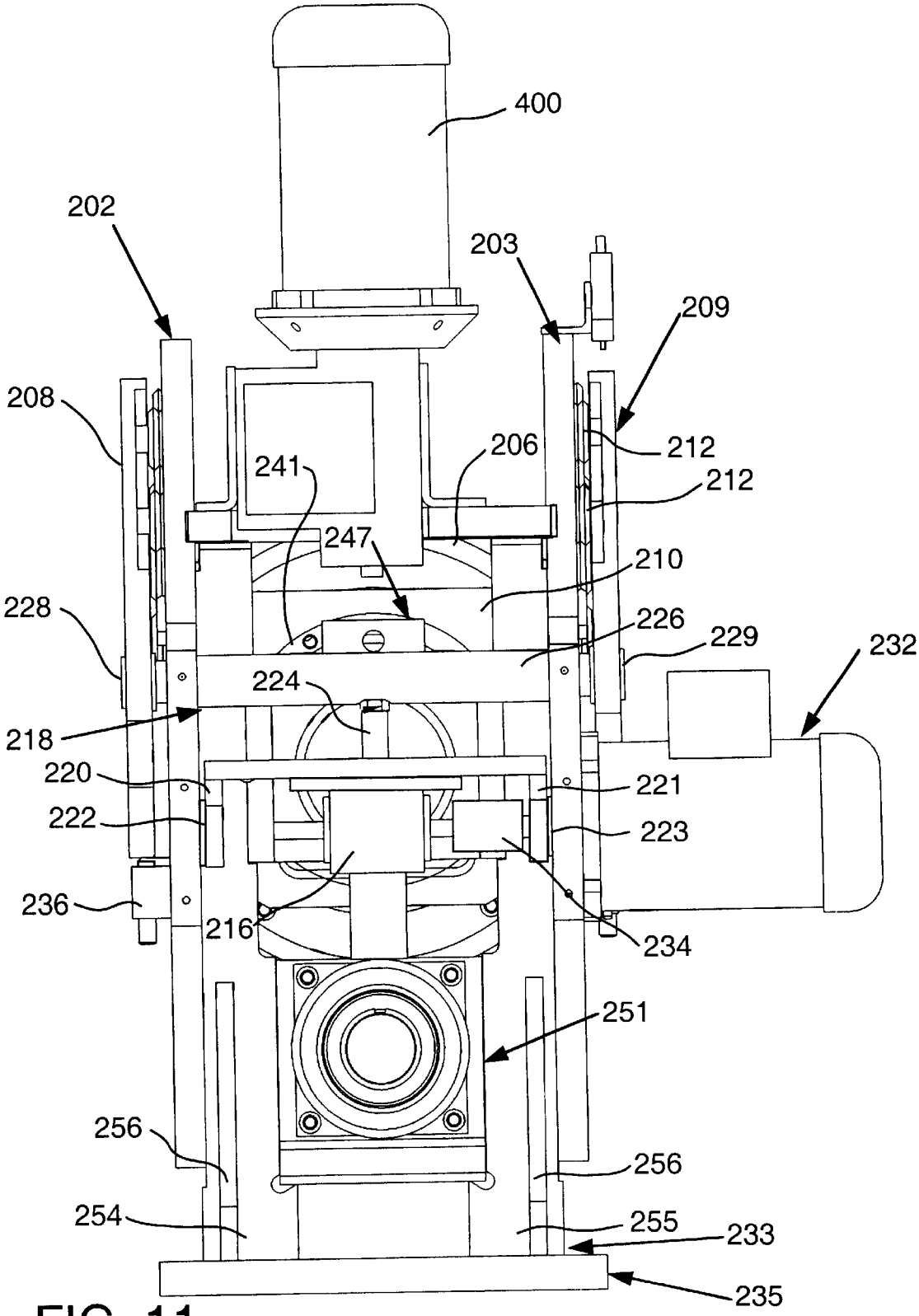
FIG. 11 is a rear-elevational view of the rollforming apparatus shown in FIG. 9.
Figure 12:
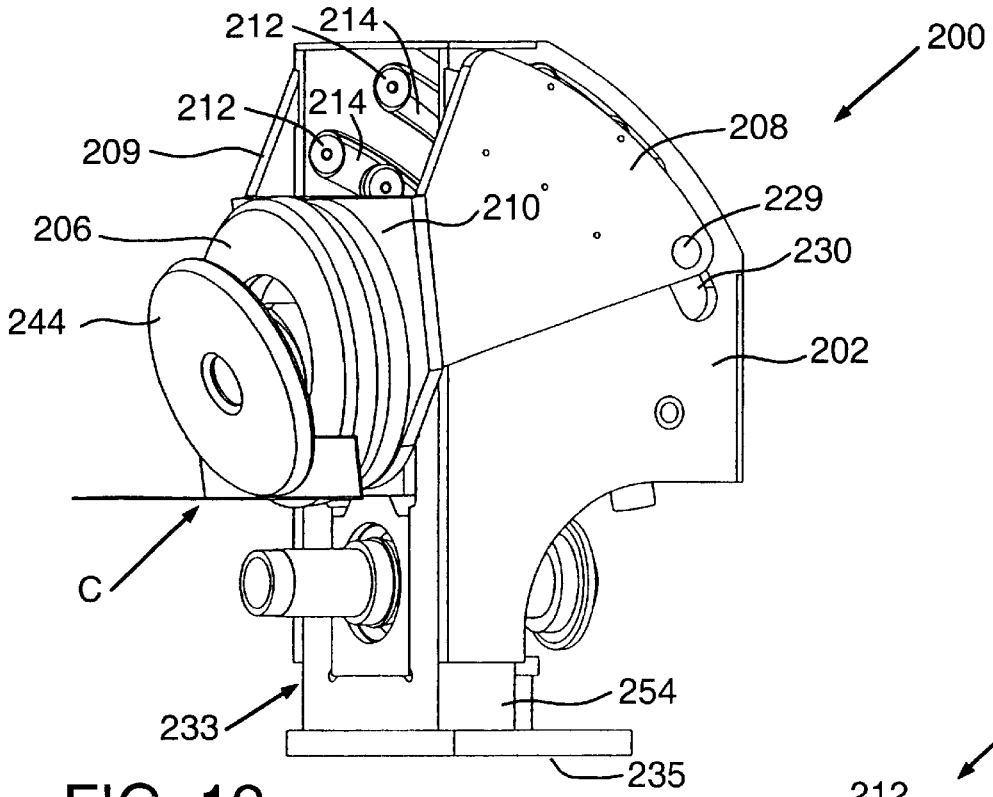
FIG. 12 is an isometric view of the rollforming apparatus shown in FIG. 9.

Rollforming apparatus 200 includes a support stand 233, that is similar to the support stand 33 described herein, having a base 235 and a first leg 254 and a second leg 225 extending from the base 235 (see FIG. 11). The rollforming apparatus 200 also includes a first support member 202 connected to the first leg 254 and a second support member 203 connected to the second leg 255. The first support member 202 and the second support member 203 are rigidly secured to the first leg 254 and the second leg 255, respectively, of the support stand 233. The rollforming apparatus 200 also includes the structural flanges 256 for providing structural support to the first leg 254 and the second leg 255.

The rollforming apparatus 200 further includes a pivot plate assembly, generally designated by reference number 204, that is moveably connected to the first and second support members 202 and 203. The pivot plate assembly 204 includes an overbend roll 206 rotatably mounted thereto. As shown and described herein, roll 206 is an idle roller that is rotated by contact with the component C passing through the rollforming station. However, roll 206 could be positively driven, if desired. Movement of the pivot plate assembly 204 with respect to the first and second support members 202 and 203 provides for angular movement of the overbend roll 206 for overbending and/or the component C.

Figure 16:
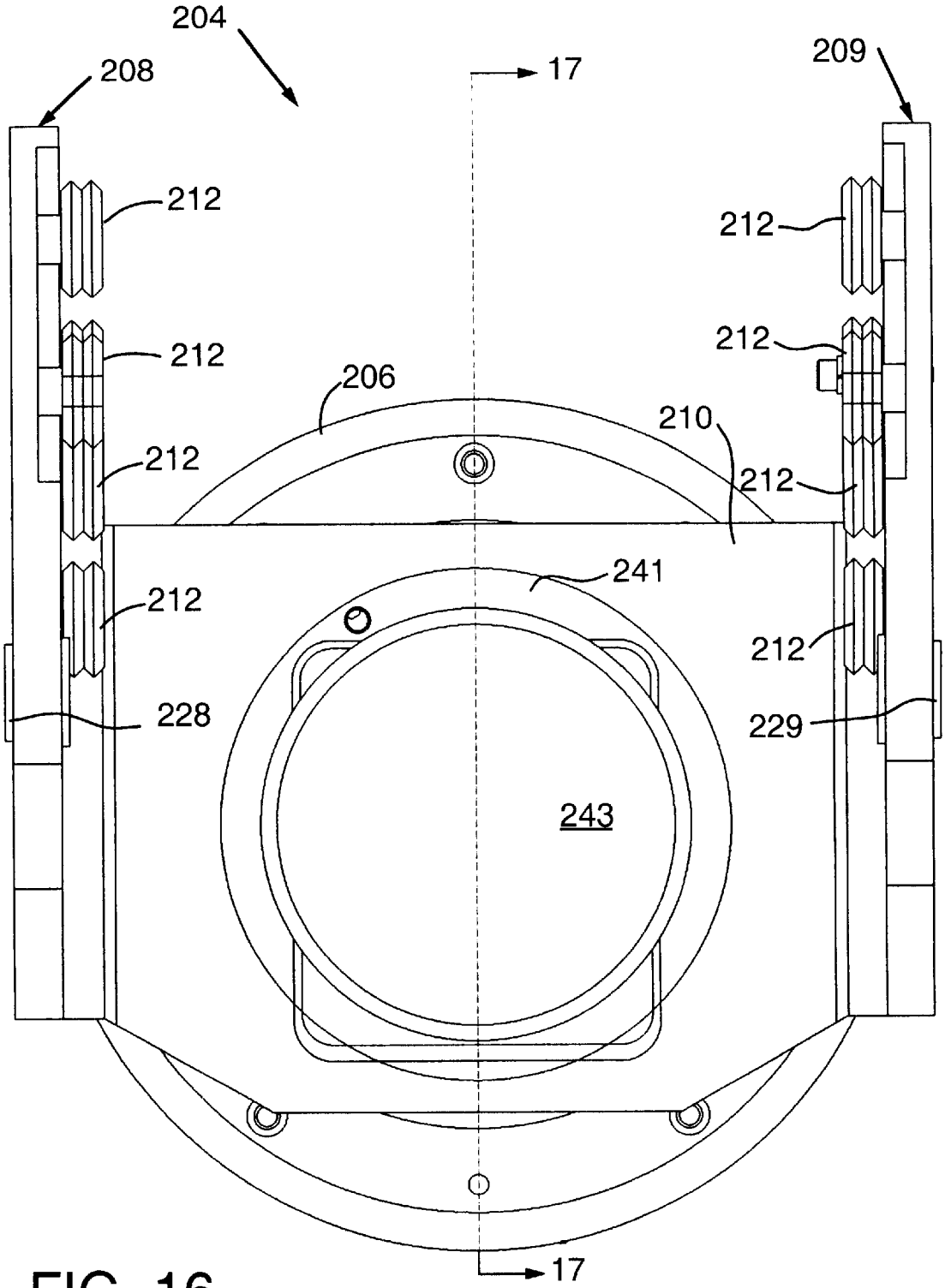
FIG. 16 is a rear-elevational view of a pivot plate assembly of the rollforming apparatus shown in FIG. 9.
Figure 17:
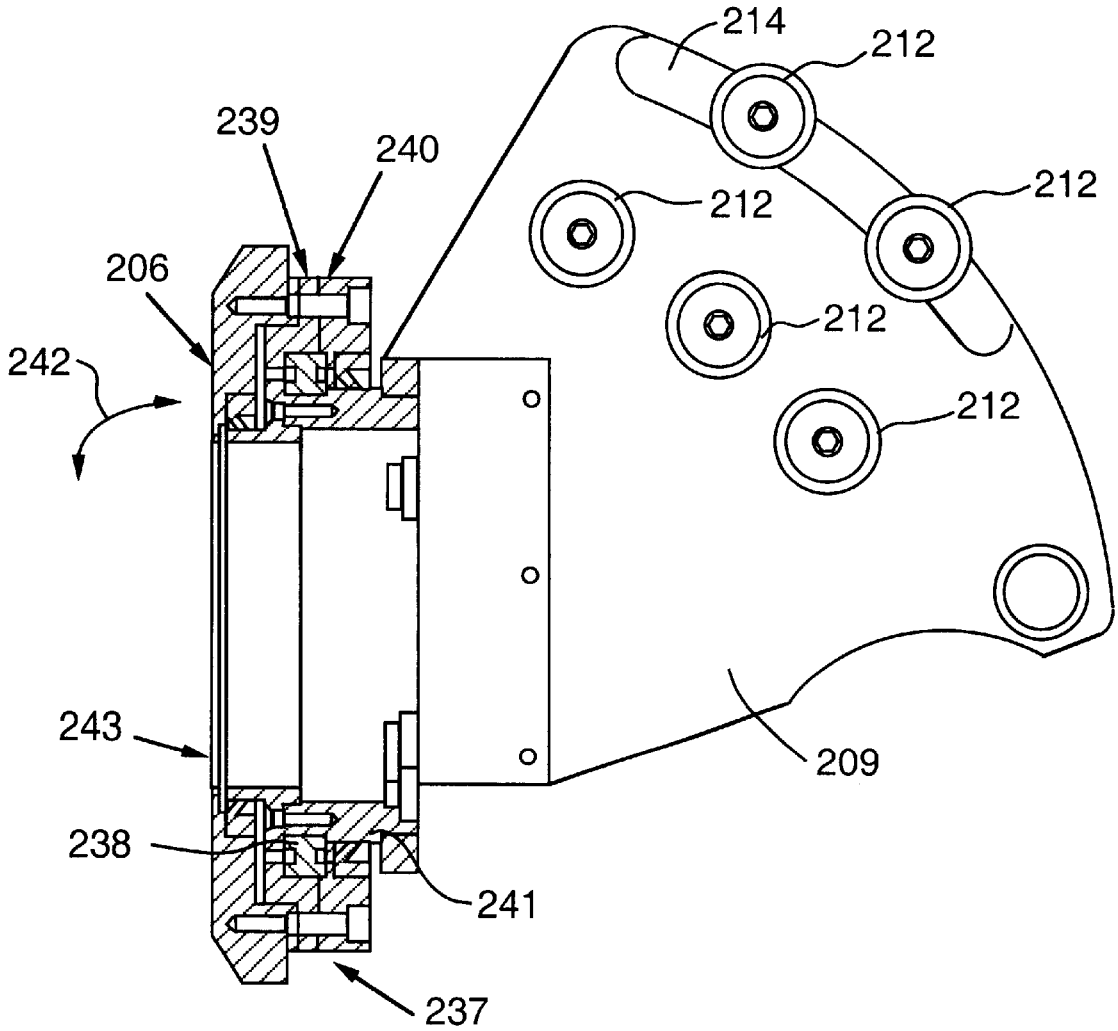
FIG. 17 is a partial sectional view taken along line 17—17 of FIG. 16.

Referring to FIGS. 16 and 17, the pivot plate assembly 204 and overbend roll 206 of this embodiment will be described in more detail. In this embodiment, the pivot plate assembly 204 includes a first pivot plate 208 moveably connected to the first support member 202 and a second pivot plate 209 moveably connected to the second support member 203. A connector plate 210 extends between the first pivot plate 208 and second pivot plate 209 for supporting the overbend roll 206. To provide for the moveable connection between the first pivot plate 208 and the first support member 202 and the moveable connection between the second pivot plate 209 and the second support member 203, the first and second pivot plates 208 and 209 each include a plurality of rollers 212 mounted thereto for receipt in corresponding arcuate slots 214 formed in the first support member 202 and the second support member 203 (see FIG. 12). The plurality of rollers 212 provide for a structurally stable connection between the pivot plate assembly 204 and the first and second support members 202 and 203 while providing for relative movement therebetween.

To adjust the positions the pivot plate assembly 204 and the first and second support members 202 and 203, there is provided a screw jack assembly 216, best shown in FIG. 11. The screw jack assembly 216 is mounted to a mounting plate 218 having a first mounting leg 220 that is secured by a fastener 222 to the first support member 202. The mounting plate 218 also includes a second mounting leg 221 that is secured by a fastener 223 to the second support member 203. The screw jack assembly 216 includes a shaft 224 that is connected to an actuator bar 226. A first fastener 228 secures an end of the actuator bar 226 to the first pivot plate 208 and a second fastener 229 secures another end of the actuator bar 226 to the second pivot plate 209. The actuator bar passes through an actuator slot 230 formed in the first support member 202 (see FIGS. 12 and 13) and an additional actuator slot formed in the second support member 203. As can be appreciated, actuation of the screwjack assembly 216 results in movement of the shaft 224 which in turn causes movement of the actuator bar 226. Because the actuator bar 226 is connected to the first pivot plate 208 by fastener 228 and to the second pivot plate 209 by fastener 229, the pivot plate assembly 204 is moved along an arcuate path corresponding to the arcuate slots 214 which receive the plurality of rollers 212.

The embodiment of the rollforming apparatus 200 (see FIG. 11) includes a motor 232 connected by a motor coupling 234 to the screwjack assembly 216. The rollforming apparatus 200 also includes a pivot stop 236' connected to the first support member 202 for cooperation with the first pivot plate 208 and an additional pivot stop (not shown) positioned for cooperation with the second pivot plate 209. This prevents overbending that may cause the lip 18 to contact the roll 244 and distort or bend the shape of the lip 18.

As best shown in FIGS. 16 and 17, the overbend roll 206 is rotatably mounted on a spindle assembly, generally designated by reference number 237, that is mounted to the connector plate 210 of the pivot plate assembly 204. Specifically, the spindle assembly 237 includes a bearing assembly 238, a bearing retainer 239 and a seal retainer 240 which mount the overbend roll 206 to a spindle 241 for rotation of the overbend roll 206 thereabout. The spindle 241 is rigidly secured to the connector plate 210. As can be appreciated, such arrangement enables the overbend roll 206 to be pivoted, as indicated by arrow 242, when the pivot plate assembly 204 is moved, as described herein.

Also in this embodiment, the spindle 241 defines a central aperture 243 which allows for a support structure for an angled roll 244 to pass therethrough, as will be explained in more detail herein.

Referring specifically to FIGS. 14–15 and 18–19, it will be further appreciated that, in this embodiment, the support stand 233 is similar to the support stand 33, as described herein. The support stand 233 includes an adjustment block 247 for supporting the angled roll 244 and an additional adjustment block 251 for supporting a lower forming roll 252. As shown and described herein, the roll 244 is an idle roller that is rotated by contact with the component C. However, roll 244 could be positively driven, if desired. The adjustment block 247 is structured similarly to the adjustment block 47 as described herein. The essential difference between adjustment block 247 and the adjustment block 47 is that adjustment block 247 does not include the central aperture 86 extending therethrough and, further, does not include the bearing assemblies 49. Rather, the adjustment block 247 supports a rigid structural shaft 257 that protrudes from the adjustment block 247 but does not move with respect to the adjustment block 247. The shaft 257 extends through the central aperture 243 formed in the overbend roll 206 and has an axis generally designated as "A—A" (see FIG. 10). The central aperture 243 is sized to permit for movement of the adjustment block 247 and shaft 257 for adjusting the position of angled roll 244 for forming components C from materials of different thicknesses. Positioned at the end of the shaft 257 is a bearing housing 259 for supporting a pair of spaced apart bearing assemblies 249. Rotatably supported by the bearing assemblies 249 is a spindle 236 that has an axis "B—B" and that rotates within the bearing housing 259. As can also be seen in FIG. 10, spindle 236 may be oriented such that its axis "B—B" is oriented at an angle relative to axis "A—A" of shaft 257. The angled roll 244 is rotatably secured to the spindle 236 for rotation therewith.

Figure 18:
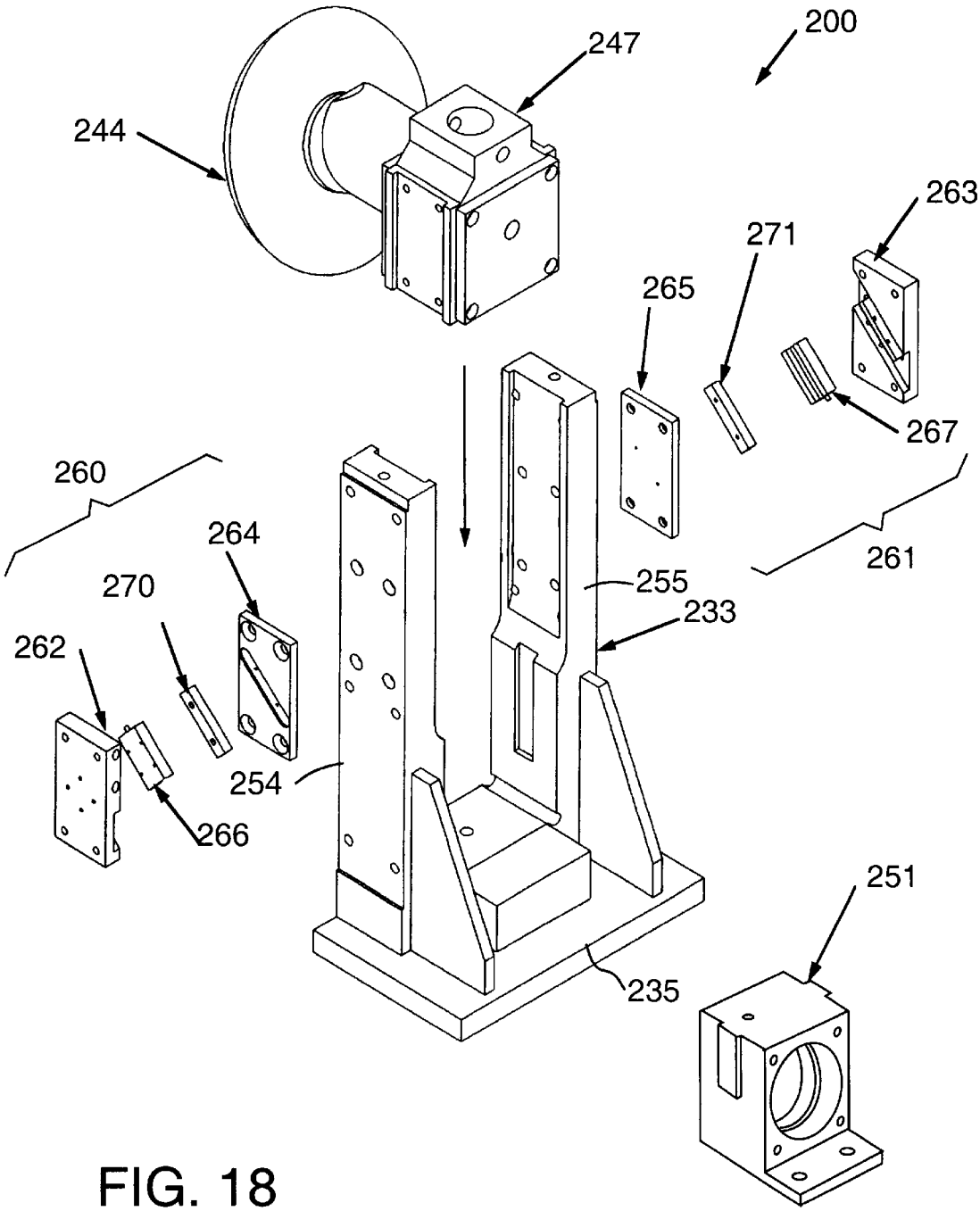
FIG. 18 is a partial, exploded isometric view of the rollforming apparatus shown in FIG. 9, and that is similar to FIG. 6A.
Figure 19:
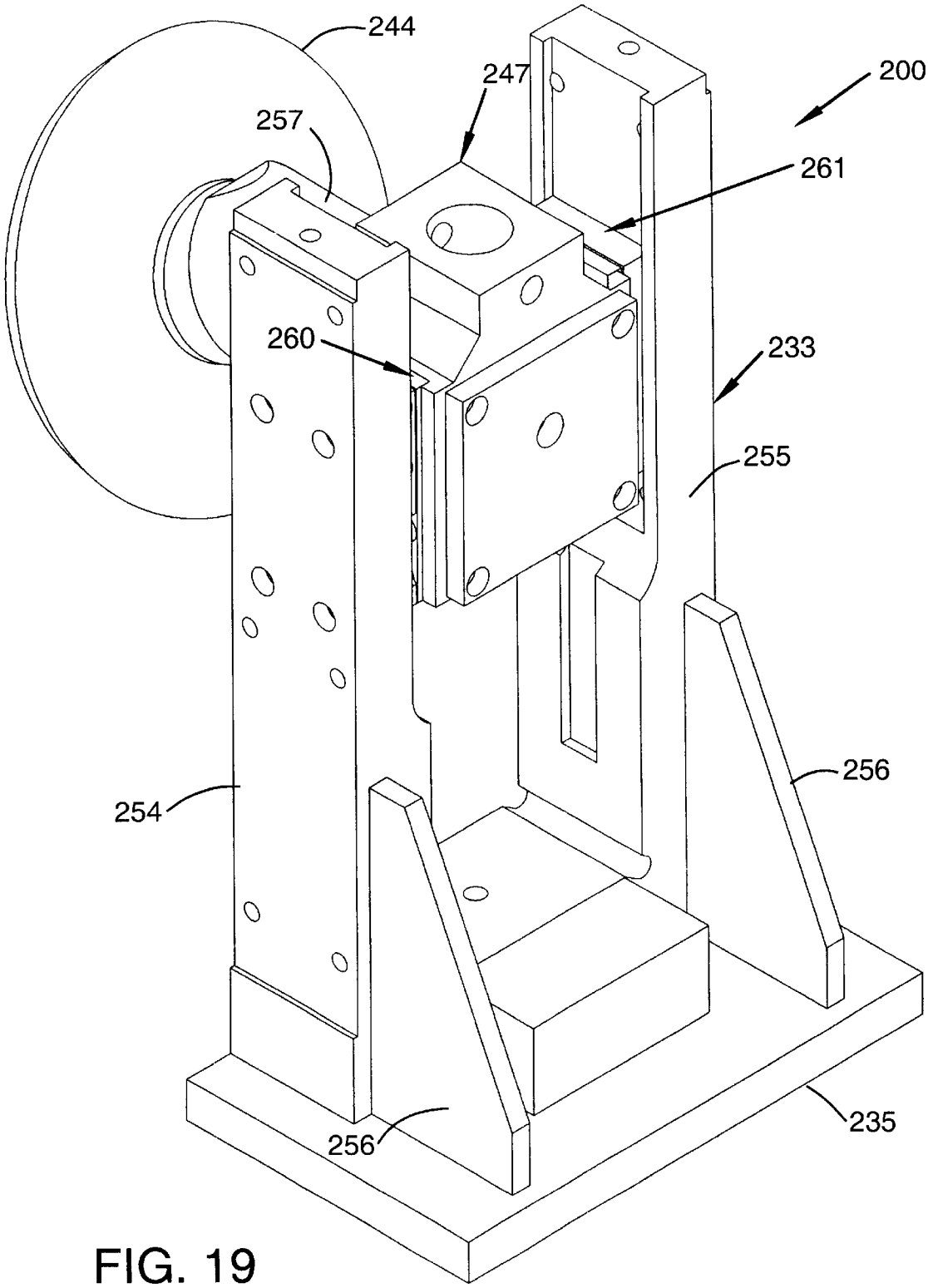
FIG. 19 is an isometric view illustrating FIG. 18 as assembled.
Figure 20:
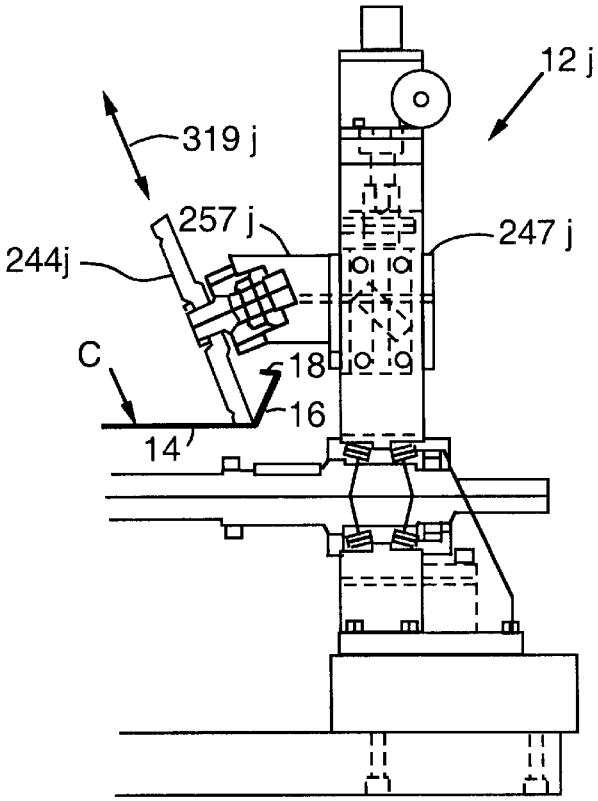
FIG. 20 is a partial sectional view of rollforming station 12*j* of the rollforming machine in FIG. 1A.
Figure 21:
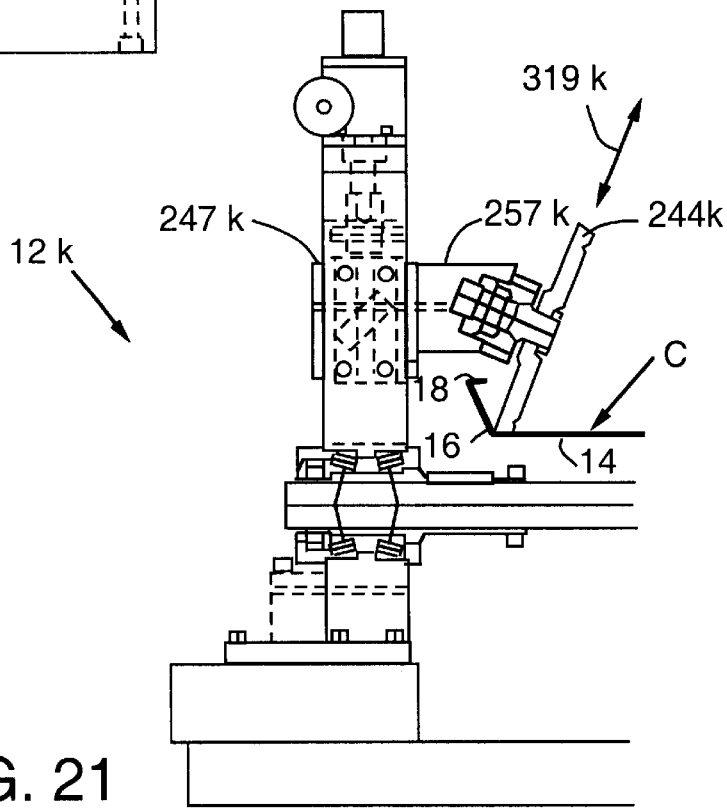
FIG. 21 is a partial sectional view of rollforming station 12*k* of the rollforming machine in FIG. 1A.

As best shown in FIG. 18, the support stand 233 of this embodiment also includes a first slide assembly 260 and a second slide assembly 261, which are similar to the slide assemblies 60 and 61 described herein in conjunction with the support stand 33. The first slide assembly 260 includes an outer gage block 262, an inner gage block 264, a bearing member 266 and a rail member 270. Similarly, the second slide assembly 60 includes an outer gage block 263, an inner gage block 265, a bearing member 267 and a rail member 271. The first slide assembly 260 and the second slide assembly 262 are positioned between the adjustment block 247 and the first leg 254 and the second leg 255 of the support stand 233 to provide for movement of the adjustment block with respect to the support stand 233, in essentially the same manner as described herein for the adjustment block 47 and the support stand 33. Those of ordinary skill in the art will appreciate that such arrangement permits the position of the angled roll 244 to be adjusted for accommodating materials of different thicknesses.

Figure 15:
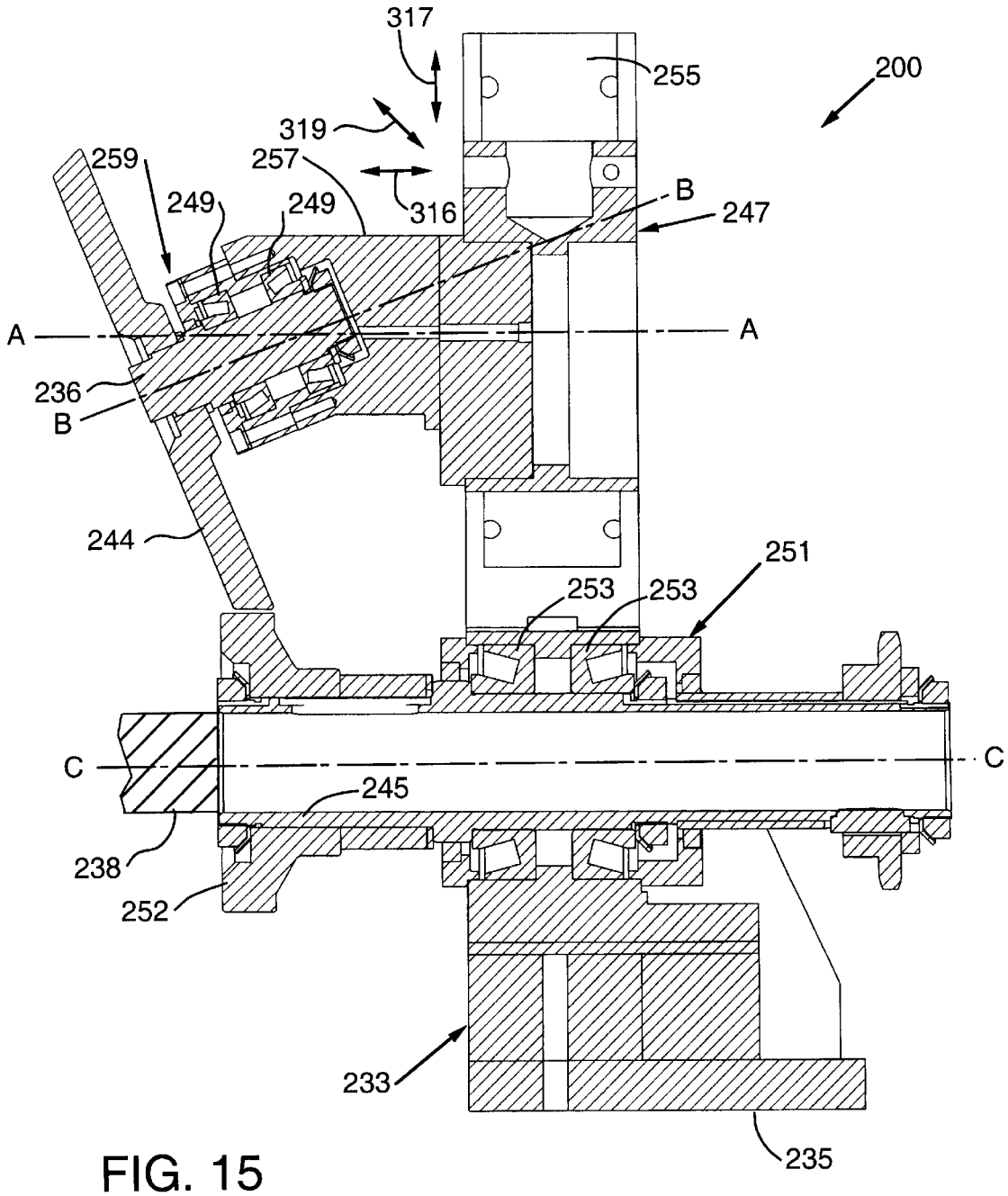
FIG. 15 is a partial sectional view taken along line 15—15 of FIG. 14.

To achieve this adjustment, it is necessary to adjust the angled roll 244 axially along longitudinal axis "A—A" of the shaft 257, as indicated by arrow 316, and transversely to the longitudinal axis "A—A" of the shaft 257, as indicated by arrow 317 (see FIG. 15). This results in movement of the angled roll 244 in the direction of arrow 319 which is the resultant sum of the axial component 316 of the shaft 257 and the normal component 317 of the shaft 257.

As best shown in FIG. 15, the support stand 233 also includes the adjustment block 251 which is constructed and arranged in essentially the same manner as adjustment block 51, as described herein. The adjustment block 251 includes bearing assemblies 253 that rotatably secure the sleeve 245 to the adjustment block 251 for rotation therein. Spindle 238 is received in the sleeve 245 and moveably connected thereto by the previously described key and keyway arrangement.

A lower support roll 279 (see FIG. 4M) is also attached to the spindle 238 for supporting the component C during the rollforming and/or overbending at station 12*m*. The support roll is rotatably secured to an additional adjustment block 250 (see FIG. 1) that is similar to the adjustment block 50 described herein. The support stand 233 and opposing support stand that contains adjustment block 250 are adjustable in an inward and outward direction, in essentially the same manner as described hereinabove for support stands 32 and 33.

Figure 10:
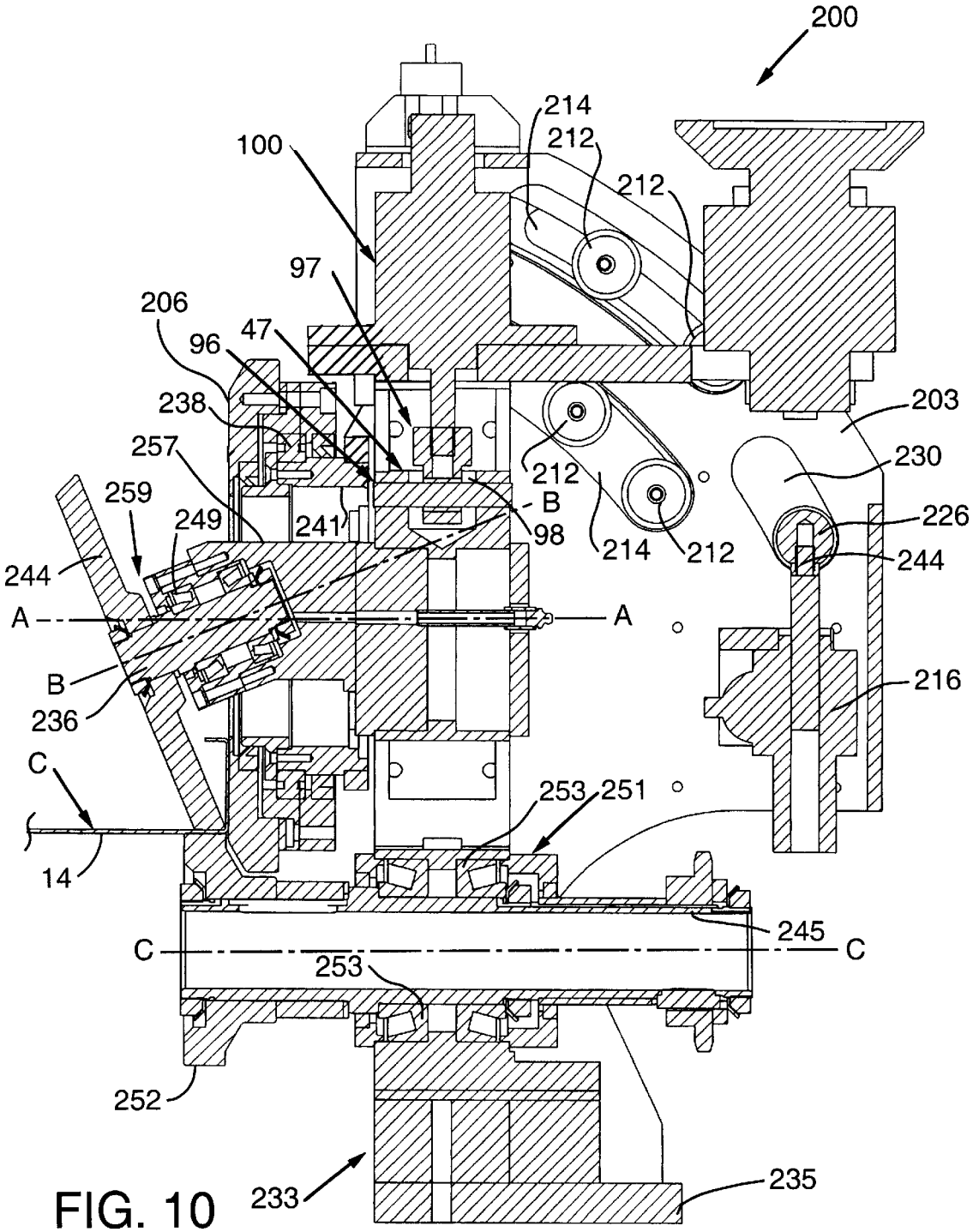
FIG. 10 is a partial sectional view taken along line 10—10 of FIG. 9.
Figure 13:
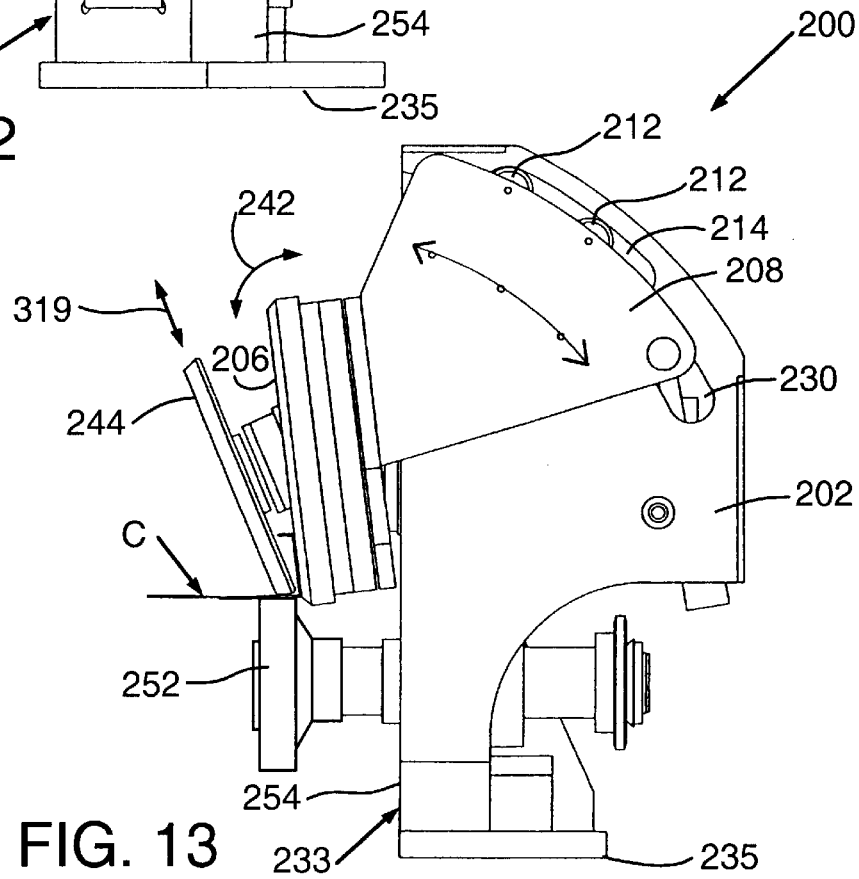
FIG. 13 is a side-elevational view of the rollforming apparatus shown in FIG. 9, with the rolls in a different position.
Figure 14:
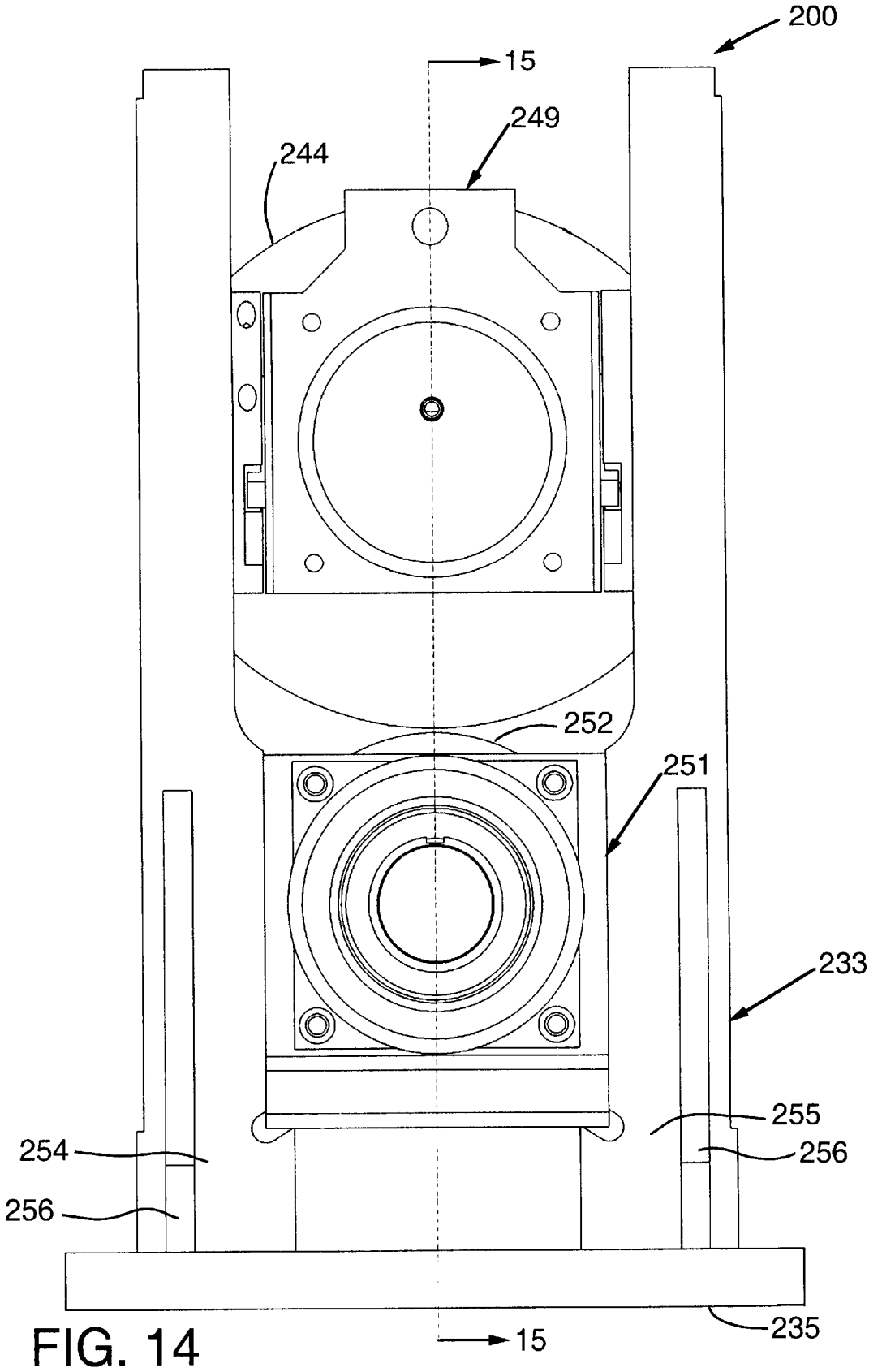
FIG. 14 is a partial rear-elevational view of the rollforming apparatus shown in FIG. 9.

Referring to FIGS. 10 and 13, the rollforming and overbending of the component C by the rollforming apparatus 200 will be described in more detail. As shown, the overbend roll 206 engages an outer portion of the leg 16 of component C. The angled roll 244 contacts a junction between an inner portion of the leg 16 and the inner portion of the web 14. The lower forming roll 252 engages an outer portion of the web 14 adjacent the angled roll 244. With the overbend roll 206 in the position shown in FIG. 10 (generally perpendicular to the axis "C—C" of the shaft 238 upon which the lower forming roll 252 is journaled) the rollforming apparatus 200 is capable of forming and/or overbending the component C with the leg 16 generally perpendicular to the web 14. As can be seen in FIG. 10, the axis "B—B" of the shaft 236 is not parallel to the axis C—C of the shaft 238. If the material being used to form the component C lacks properties that might result in springback, then upon exiting the rollforming apparatus 200 the component C should remain with the leg 16 generally perpendicular to the web 14. For materials that do exhibit properties that may result in springback, angular adjustment of the overbend roll 206, in the direction of arrow 242 and as shown in FIG. 13, will result in overbending of the component C. Specifically, additional bending application is applied to the leg 16 about the junction where the angled roll 244 contacts the component C such that when the component C exits the rollforming apparatus 200, the leg 16 should return, as a result of the springback, to a position that is generally perpendicular to the web 14. The range of angular motion of the overbend roll 206 may be about 84 to 91 degrees with respect to a generally horizontal axis. It will be understood that the rollforming apparatus 200 is capable of rollforming and/or overbending the component C such that the leg 16 may be at other angles than generally perpendicular with respect to the web 14.

Accordingly, it will be appreciated that the rollforming apparatus 200 provides an efficient and flexible apparatus for rollforming and/or overbending the component C. The overbend roll 206, the angled roll 244 and the lower forming roll 252 of the rollforming apparatus 200 may be adjusted and positioned, as described herein, to provide for a high degree of flexibility when rollforming and/or overbending the component C. As can be appreciated from the description set forth herein and the drawings attached hereto, the overbend roll 206, as rotatably mounted to the spindle 241, is independently adjustable from the angled roll 244 and the lower forming roll 252. The angled roll 244, which is secured to spindle 236 for rotation therewith, is also independently adjustable of the overbend roll 206 and the lower forming roll 252. The lower forming roll 252 is laterally adjustable by moving the stand 233 in an inward or outward direction which will result in the overbend roll 206 and spindle 241, as well as the overbend roll 244 and spindle 236 also moving in an inward or outward direction in conjunction with movement of the support stand 233. the angled roll 244 and the bottom roll 252. The angled roll 244, which is secured to spindle 236 for rotation therewith, is also independently adjustable of the overbend roll 206 and the bottom roll 252. The bottom roll 252 is laterally adjustable by moving the stand 233 in an inward or outward direction which will result in the overbend roll 206 and spindle 241, as well as the overbend roll 244 and spindle 236 also moving in an inward or outward direction in conjunction with movement of the support stand 233.

Referring to FIGS. 4J–4K and 20–21, there is illustrated rollforming stations 12*j* and 12*k*. Rollforming stations 12*j* and 12*k* are essentially identical only positioned on opposing sides of the rollforming line of rollforming machine 10. Rollforming stations 12*j* and 12*k* further progress the formation of the legs 16 of the component C. Rollforming station 12*j* includes adjustment block 247*j* for supporting shaft 257*j* which in turn supports angled roller 244*j*. The adjustment block 247*j*, the shaft 257*j* and the angled roller 244*j* operate in essentially the same manner as adjustment block 247, shaft 257 and angled roller 244, as described herein. The adjustment block 247*j* allows for adjustment of the angled roller 244*j* in the direction of arrow 319*j* in order to accommodate materials of different thicknesses for forming the component C. Similarly, rollforming station 12*k* includes adjustment block 247*k*, shaft 257*k* and angled roller 244*k* to provide for adjustment of the angled roller 244*k* in the direction of arrow 319*k*.

Figure 22:
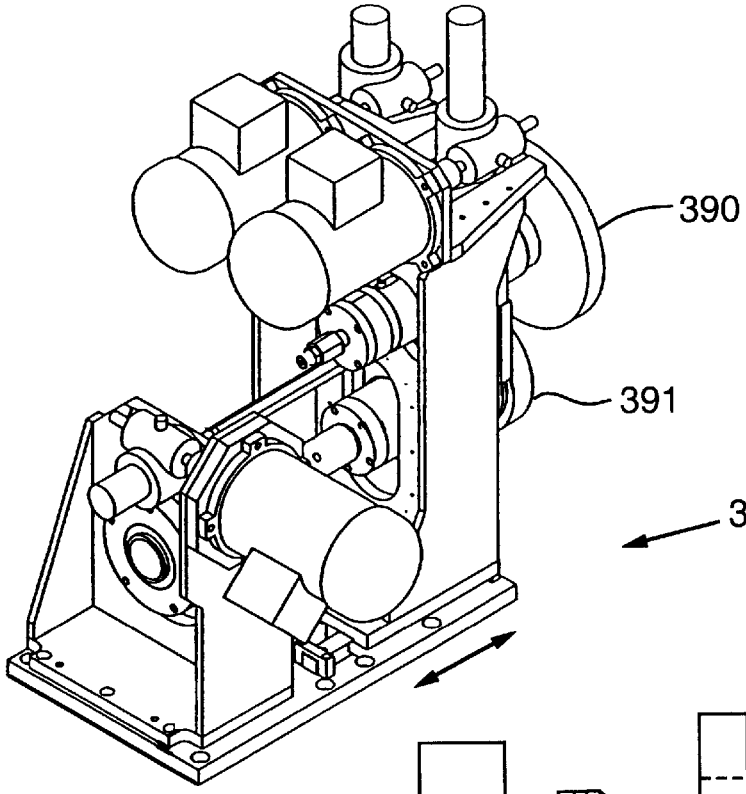
FIG. 22 is an isometric view of a typical straightener for use in accordance with an embodiment of the invention, and as shown in FIG. 1A.
Figure 23:
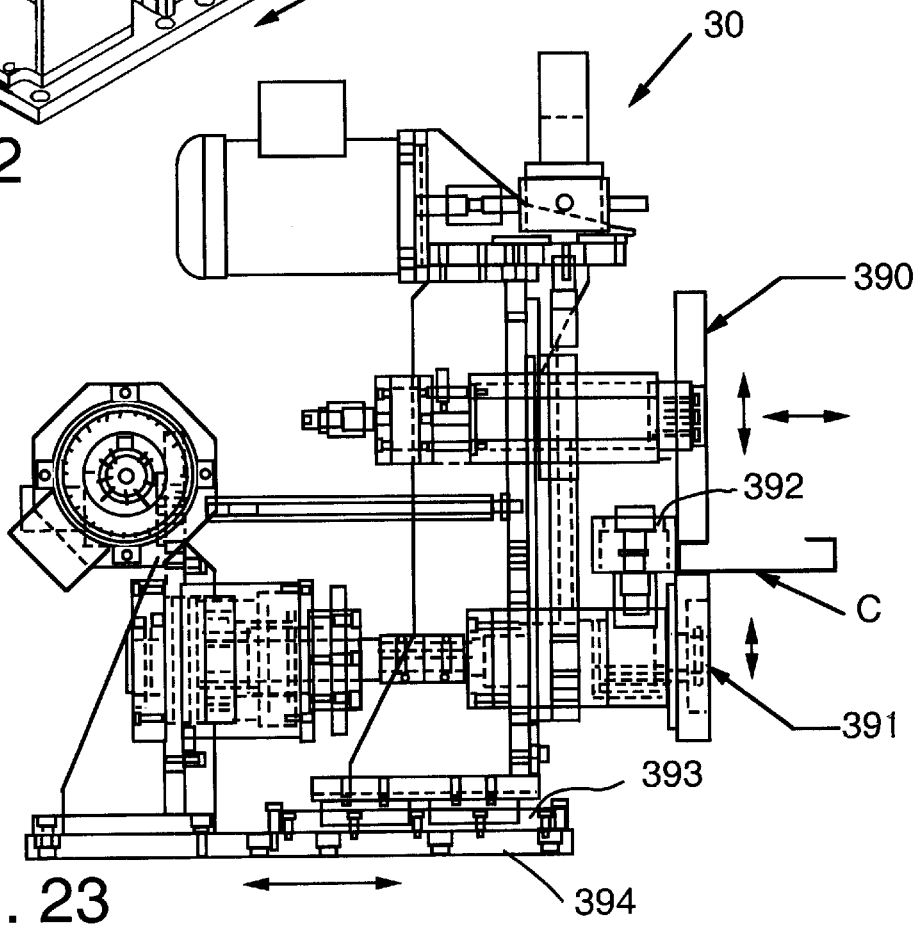
FIG. 23 is a partial sectional view of the straightener shown in FIG. 22.

Referring to FIGS. 22 and 23, there is illustrated a typical straightener 30 for use with the rollforming machine 10. The straightener 30 may be a conventionally known straightener utilized to adjust the component C for camber, twist, bow, etc., as is generally known in the rollforming industry. Generally, the straightener 30 includes an adjustable top roll 390, an adjustable bottom roll 391 and a side roll 392. The straightener 30 is mounted to a linear slide bearing 393 which in turn is mounted to the support frames 24 and 25. The linear slide bearing 393 allows for the entire straightener 30 to be laterally adjustable in order to accommodate the component C having a web of different widths.

Whereas particular embodiments of the invention have been described herein for the purpose of illustrating the invention and not for the purpose of limiting the same, it will be appreciated by those of ordinary skill in the art that numerous variations of the details, materials, and arrangement of parts and directional references, such as, for example, up, down, horizontal, vertical, top or bottom, may be made within the principle and scope of the invention without departing from the invention as described in the appended claims. For example, the described adjustment blocks may be alternately constructed and arranged to achieve similar movement thereof by using similar means such as opposed wedges cut on angles that may be attached internally or externally to the adjustment block housing for movement with respect to the stand. In addition, the adjustment blocks for adjustment of the upper spindle and associated forming rolls may be employed with the lower spindle and associated forming rolls, if desired.

What is claimed is:

1. A rollforming apparatus, comprising:

a moveable support stand having a base with a first leg and a second leg extending therefrom;

a pivot plate assembly having a first pivot plate member pivotally coupled to said first leg of said movable support stand for selective pivotal travel relative thereto and a second pivot plate member pivotally coupled to said second leg for selective pivotal travel relative thereto;

a first forming roll rotatably mounted to a first spindle, said first spindle connected to said pivot plate assembly to provide for angular movement of said first forming roll relative to said support stand;

a second forming roll mounted to a second spindle that extends through a central aperture defined by said first forming roll, said second spindle moveably connected to said support stand to provide for movement of said second forming roll relative to the angular movement of said first forming roll; and a third forming roll rotatably supported by said support stand for movement therewith.

2. The apparatus of claim 1, wherein said third forming roll is rotatably supported by a spindle arrangement that is mounted to said first leg and said second leg of said support stand.

3. The apparatus of claim 2, wherein said spindle arrangement includes a third spindle, a sleeve slideably connected to said third spindle, said third forming roll supported by said sleeve.

4. The apparatus of claim 1, further comprising:

a first support member coupled to said first leg of said movable support stand, said first support member having a first arcuate slot therein for receiving a first roller attached to said first pivot plate member; and a second support member coupled to said first leg of said movable support stand said second support member having a second arcuate slot therein for receiving a second roller attached to said second pivot plate member.

5. The apparatus of claim 1, further comprising an actuator assembly connected to said support stand, said actuator assembly including an actuator member connected to said pivot plate assembly such that actuation of said actuator assembly causes movement of said pivot plate assembly relative to said support stand.

6. The apparatus of claim 4, further comprising an actuator assembly connected to at least one of said first and second support members, said actuator assembly including an actuator member connected to said pivot plate assembly such that said actuator member extends through an actuator slot defined by at least one of said first and second pivot plates.

7. The apparatus of claim 1, wherein said second forming roll is contained in a plane that is generally perpendicular to a longitudinal axis of said second spindle.

8. The apparatus of claim 1, wherein said first forming roll is contained in a first plane and said second forming roll is contained in a second plane that intersects said first plane.

9. The apparatus of claim 1, wherein the movement of said second forming roll is linear movement.

10. A rollforming machine for forming a component having a generally C-shaped cross section with a web, a pair of legs connected to said web, and a pair of lips connected to said legs, comprising:

a plurality of rollforming stations comprising:

a first rollforming station structured and arranged to form the lips of the component;

a second rollforming station structured and arranged to at least partially form the legs of the component; and a third rollforming station comprising:

a moveable support stand;

a pivot plate assembly movably supported on said movable support stand for selective pivotal travel relative thereto;

a first forming roll rotatably mounted to a first spindle for rotation about a first axis, said first spindle connected to said pivot plate assembly to provide for angular movement of said first forming roll relative to said support stand;

a second forming roll mounted to a second spindle for rotation about a second axis that extends through a central aperture defined by said first forming roll, said second spindle moveably connected to said support stand to provide for movement of said second forming roll relative to the angular movement of said first forming roll; and a third forming roll rotatably supported by said support stand for movement therewith, said third forming roll located beneath said second forming roll and is rotatable about a third axis that is not parallel to said second axis.

11. The machine of claim 10, further comprising an additional rollforming station structured and arranged to partially form the legs of the component.

12. A rollforming machine for forming a component having a generally U-shaped cross section with a web and a pair of legs connected to said web, comprising:

a plurality of rollforming stations comprising:

a first rollforming station structured and arranged to form the legs of the component;

a second rollforming station comprising:

a moveable support stand having a first leg and a second leg;

a pivot plate assembly movably supported on said movable support stand for selective pivotal travel relative thereto, said pivot plate assembly having a first pivot plate pivotally coupled to said first leg of said movable support stand and a second pivot plate movably coupled to said second leg of said movable support stand;

a first forming roll rotatably mounted to a first spindle, said first spindle connected to said pivot plate assembly to provide for angular movement of said first forming roll relative to said support stand;

a second forming roll mounted to a second spindle that extends through a central aperture defined by said first forming roll, said second spindle moveably connected to said support stand to provide for movement of said second forming roll relative to the angular movement of said first forming roll;

a third forming roll rotatably supported by said support stand for movement therewith; and a pivot stop connected to said movable support stand for contact with said pivot plate assembly to adjustably limit the pivotal travel of said pivot plate assembly.

13. A rollforming apparatus, comprising:

an upstanding standing support stand;

a lower forming roll having an axis and being supported on a lower forming roll shaft rotatably supported by said support stand;

a pivot assembly supported on said support stand for selective pivotal travel relative to said upstanding support stand;

an overbend roll rotatably supported on said pivot assembly for pivotal travel therewith; and an angled roll couple to an angled spindle extending through an opening in said overbend roll and movably supported on said upstanding support stand, said angled spindle oriented along an axis that is not parallel to said axis of said lower forming roll shaft.

14. The rollforming apparatus of claim 13 wherein said angled spindle is rotatably supported relative to a support shaft that is non-rotatably supported in an adjustment block that is movably supported in said upstanding support stand.

15. The rollforming apparatus of claim 14 wherein said upstanding support stand has first and second upstanding legs spaced from each other to receive said adjustment block therebetween and wherein said roll forming apparatus further comprises a first slide assembly coupled to said first upstanding leg and said adjustment block and a second slide assembly coupled to said second upstanding leg and said adjustment block, said first and second slide assemblies defining a path of angular travel of said adjustment block upon an application of a vertical force thereto.

16. The rollforming apparatus of claim 15 further comprising a screw jack assembly coupled to said adjustment block for applying said vertical force thereto.

17. The rollforming apparatus of claim 15 wherein said first slide assembly comprises:

a first outer gage block coupled to said first upstanding leg;

a first bearing member coupled to said first outer gage block, said first bearing member having a first angled slot therein;

a first inner gage block coupled to said adjustment block; and a first rail member coupled to said first inner gage block and slidably received in said first angled slot in said first bearing member and wherein said second slide assembly comprises:

a second outer gage block coupled to said second upstanding leg;

a second bearing member coupled to said second outer gage block, said second bearing member having a second angled slot therein;

a second inner gage block coupled to said adjustment block; and a second rail member coupled to said second inner gage block and slidably received in said second angled slot in said second bearing member.

18. The rollforming apparatus of claim 17 further comprising a screw jack assembly coupled to said adjustment block for applying said vertical force thereto.

19. The rollforming apparatus of claim 13 wherein said pivot assembly comprises:

a first support member connected to a portion of said upstanding support stand, said first support member having a first slot therein;

a second support member connected to another portion of said upstanding support stand and spaced from said first support member, said second support member having a second slot therein;

a first pivot plate having at least one first roller coupled thereto and received in said first slot in said first support member;

a second pivot plate having at least one second roller coupled thereto and received in said second slot in said second support member; and a connector plate extending between said first and second pivot plates and coupled thereto, said first forming roll rotatably coupled to said connector plate.

20. A rollforming apparatus, comprising:

an upstanding standing support stand having first and second upstanding legs spaced from each other;

an adjustment block received between said first and second upstanding legs of said upstanding support stand;

a first slide assembly coupled to said first upstanding leg and said adjustment block and a second slide assembly coupled to said second upstanding leg and said adjustment block, said first and second slide assemblies defining a path of angular travel of said adjustment block upon an application of a vertical force thereto;

a lower forming roll supported on a lower forming roll shaft rotatably supported by said support stand, said lower forming roll having an outer circumference;

an overbend roll rotatably and pivotably supported on said upstanding support stand, said overbend roll having an outer circumference and being oriented relative to said lower forming roll such that said outer circumference of said overbend roll is closer to said lower forming roll shaft than said outer circumference of said lower forming roll to define a corner area therebetween; and an angled forming roll mounted to a second spindle that is rotatably coupled to said adjustment block, said second spindle further extending through a central aperture in said overbend roll and being moveably connected to said support stand to provide for movement of said angled forming roll into said corner area.

21. The rollforming apparatus of claim 20 further comprising a screw jack assembly coupled to said adjustment block for applying said vertical force thereto.

22. The rollforming apparatus of claim 20 wherein said first slide assembly comprises:

a first outer gage block coupled to said first upstanding leg;

a first bearing member coupled to said first outer gage block, said first bearing member having a first angled slot therein;

a first inner gage block coupled to said adjustment block; and a first rail member coupled to said first inner gage block and slidably received in said first angled slot in said first bearing member and wherein said second slide assembly comprises:

a second outer gage block coupled to said second upstanding leg;

a second bearing member coupled to said second outer gage block, said second bearing member having a second angled slot therein;

a second inner gage block coupled to said adjustment block; and a second rail member coupled to said second inner gage block and slidably received in said second angled slot in said second bearing member.

23. The rollforming apparatus of claim 22 further comprising a screw jack assembly coupled to said adjustment block for applying said vertical force thereto.

24. The rollforming apparatus of claim 20 wherein said overbend roll is rotatably supported on a pivot assembly comprising:

a first support member connected to a portion of said upstanding support stand, said first support member having a first slot therein;

a second support member connected to another portion of said upstanding support stand and spaced from said first support member, said second support member having a second slot therein;

a first pivot plate having at least one first roller coupled thereto and received in said first slot in said first support member;

a second pivot plate having at least one second roller coupled thereto and received in said second slot in said second support member; and a connector plate extending between said first and second pivot plates and coupled thereto, said first forming roll rotatably coupled to said connector plate.

* * * * *

UNITED STATES PATENT AND TRADEMARK OFFICE

CERTIFICATE OF CORRECTION

PATENT NO. : 6,604,397 B2
DATED : August 12, 2003
INVENTOR(S) : Alfred C. Patty

It is certified that error appears in the above-identified patent and that said Letters Patent is hereby corrected as shown below:

Column 1,
Line 20, delete “well-know” and replace therewith -- well-known --.

Column 5,
Line 7, delete “capable of manufactured” and replace therewith -- capable of being manufactured --.
Line 28, delete “12-*l*” and replace therewith -- 12*l* --.

Column 10,
Line 45, delete “12-*l*” and replace therewith -- 12*l* --.

Column 12,
Line 66, delete “12-*l*” and replace therewith -- 12*l* --.

Column 13,
Lines 3 and 8, delete “12-*l*” and replace therewith -- 12*l* --.

Column 16,
Lines 38-47, delete lines 38-47.

Signed and Sealed this

Twenty-second Day of June, 2004

JON W. DUDAS
*Acting Director of the United States Patent and Trademark Office*